US010443234B2

(12) United States Patent
Stronks et al.

(10) Patent No.: US 10,443,234 B2
(45) Date of Patent: Oct. 15, 2019

(54) CURTAIN WALL SYSTEM AND COMPONENTS THEREOF

(71) Applicant: Erie Architectural Products Inc., Lakeshore (CA)

(72) Inventors: Ronald A. Stronks, Tecumseh (CA); Keith L. Kee, Mississauga (CA); Derrick A. Stronks, Windsor (CA)

(73) Assignee: Erie Architectual Products Inc., Lakeshore, Ontario (CA)

( * ) Notice: Subject to any disclaimer, the term of this patent is extended or adjusted under 35 U.S.C. 154(b) by 0 days.

(21) Appl. No.: 14/625,004

(22) Filed: Feb. 18, 2015

(65) Prior Publication Data

US 2016/0237682 A1 Aug. 18, 2016

(51) Int. Cl.
*E04B 2/96* (2006.01)

(52) U.S. Cl.
CPC ..... *E04B 2/965* (2013.01)

(58) Field of Classification Search
CPC . E04B 2/96; E04B 2/962; E04B 2/965; E04B 2/967; E04B 2/88
USPC ..... 52/204.5, 208, 209, 204.593, 204.595, 52/204.597, 653.2, 655.1, 656.1, 656.9, 52/717.02
See application file for complete search history.

(56) References Cited

U.S. PATENT DOCUMENTS 3,057,444 A 10/1962 Walberg
3,345,794 A 10/1967 Proud
3,553,918 A * 1/1971 Dauson ..... E04B 2/96 52/208
3,938,291 A * 2/1976 Criswell ..... E06B 3/68 52/204.597
4,004,389 A 1/1977 DiFazio
4,021,987 A * 5/1977 Schnebel ..... E04B 2/96 52/235
4,055,923 A * 11/1977 Biebuyck ..... E06B 7/14 52/204.591
4,214,415 A * 7/1980 Sukolics ..... E04B 2/96 49/506

(Continued)

FOREIGN PATENT DOCUMENTS

EP 1643049 A2 * 4/2006 ..... E04B 2/967
EP 2444579 B1 5/2014

OTHER PUBLICATIONS

Machine translation of EP 1643049 A2, obtained from http://translationportal.epo.org/emtp/translate/?ACTION=description-retrieval&COUNTRY=EP&ENGINE=google&FORMAT=docdb&KIND=A2&LOCALE=en_EP&NUMBER=1643049&OPS=ops.epo.org/3.2&SRCLANG=de&TRGLANG=en (last accessed on Nov. 22, 2016).*

*Primary Examiner* — Theodore V Adamos

(57) ABSTRACT

A curtain wall system including panel units to be secured to a building structure between the building structure and an external space. Each panel unit includes a first mullion segment, a second mullion segment, and one or more panels. The first mullion segment of each of the panel units is attachable to a secured second mullion segment of an installed one of the panel units, to provide a mullion assembly defining a central cavity therein in which a central volume of air is isolated for at least partially thermally insulating the building structure relative to the external space, and a boundary region between the central cavity and the external space. Each mullion assembly includes one or more thermal insulator elements to at least partially define one or more thermal breaks between the external space and the boundary region.

24 Claims, 26 Drawing Sheets

(56) References Cited

U.S. PATENT DOCUMENTS 4,552,790 A 11/1985 Francis
4,563,849 A 1/1986 Mangal
4,565,040 A 1/1986 Kaminaga
4,590,725 A * 5/1986 Kaminaga ..... E04B 2/90 52/204.591
4,599,838 A 7/1986 Kaminaga
4,625,482 A * 12/1986 Kaminaga ..... E04B 2/96 49/DIG. 1
4,961,975 A 10/1990 Bejnar
5,076,034 A * 12/1991 Bandy ..... E04B 2/967 52/204.591
5,083,405 A 1/1992 Miller
5,253,459 A * 10/1993 Parinas ..... E04B 2/96 52/204.591
5,355,645 A 10/1994 Farag
5,381,637 A 1/1995 Farag
5,493,831 A 2/1996 Jansson
5,579,616 A 12/1996 Farag
6,158,182 A * 12/2000 Biebuyck ..... E04B 2/96 52/204.53
6,401,410 B2 6/2002 Kenny et al.
6,658,804 B2 * 12/2003 Leytes ..... E04B 2/885 52/1
7,619,092 B2 * 11/2009 Takahashi ..... C07K 5/1008 546/225
7,644,549 B2 1/2010 Speck
7,661,237 B2 2/2010 Jakob-Bamberg et al.
7,676,999 B2 3/2010 Arias
7,827,745 B2 * 11/2010 Franceschet ..... E04B 2/90 52/235
7,827,746 B2 11/2010 Speck
7,832,160 B2 * 11/2010 Farag ..... E06B 3/5427 52/204.57
8,341,901 B2 1/2013 Loyd
8,596,007 B2 12/2013 Hibbs
8,615,938 B2 12/2013 Arbour
8,631,623 B2 1/2014 Engstrom
8,991,121 B1 * 3/2015 Baker ..... E04B 2/965 52/235
2002/0124499 A1 * 9/2002 Braybrook ..... E04B 2/96 52/235
2010/0115863 A1 * 5/2010 Braybrook ..... E04B 2/96 52/204.62
2011/0296775 A1 * 12/2011 Dolby ..... E06B 3/5427 52/235
2012/0047842 A1 * 3/2012 Braybrook ..... E04B 2/88 52/698
2014/0331579 A1 * 11/2014 Evensen ..... E04B 2/885 52/204.593
2014/0345215 A1 * 11/2014 Magoon ..... E06B 3/5427 52/235
2015/0284951 A1 * 10/2015 Frederick ..... E04B 2/965 52/235

* cited by examiner

CURTAIN WALL SYSTEM AND COMPONENTS THEREOF

FIELD OF THE INVENTION

The present invention is a curtain wall system to be secured to a building structure.

BACKGROUND OF THE INVENTION

Curtain wall systems, which typically include panels including glass panes and other materials, are well known in the art. The curtain wall is secured to a frame of a structure (e.g., a multi-story building) to provide the exterior facade of the structure.

The curtain wall system typically is not load-bearing, except to the extent that it bears its own weight. During installation of a unitized curtain wall, the panels are connected to each other. In designing the curtain wall system, a number of factors typically are considered. For example, the method of installing the panels to form the curtain wall system ideally should be relatively simple in practice, because of the significant costs that may otherwise be incurred. However, the known methods of installation are still relatively complex.

Also, although the thermal efficiency of the known curtain wall systems has been improving, it is generally thought to be somewhat unsatisfactory. In addition, the prior art curtain wall systems typically provide only a limited number of options for designers (e.g., architects) regarding the appearance of the installed curtain wall system.

SUMMARY OF THE INVENTION

There is a need for a curtain wall system that overcomes or mitigates one or more of the disadvantages or defects of the prior art. Such disadvantages or defects are not necessarily included in those listed above.

In its broad aspect, the invention provides a curtain wall system to be secured to a building structure between the building structure and an external space. The curtain wall system includes a number of panel units attachable to each other respectively, each panel unit including a first mullion segment, a second mullion segment, one or more panels positioned between the first and second mullion segments, and one or more transverse mullion segments. The first mullion segment includes an elongate first main portion extending between first top and bottom ends thereof and having a first exterior side thereof. The second mullion segment includes an elongate second main portion extending between second top and bottom ends thereof and comprising a second exterior side thereof. The transverse mullion segment is selected from the group consisting of first and second transverse mullion segments, and is secured between the first and second exterior sides of the first and second main portions to locate the first and second main portions spaced apart from each other by a preselected distance. The panel is held between the first and second mullion segments and transverse mullion segment(s). The first mullion segment of each of the panel units is attachable to a secured second mullion segment of a first installed one of the panel units having a secured panel and installed on the building structure, to provide a mullion assembly defining a central cavity therein in which a central volume of air is isolated for at least partially thermally insulating the building structure relative to the external space. The first and secured second mullion segments, when attached together, additionally defining a boundary region between the central cavity and the external space. Each mullion assembly includes one or more thermal insulator elements at least partially positioned between the panel and the secured panel to at least partially define one or more thermal breaks between the external space and the boundary region.

In another aspect, the thermal insulator element extends between an inner end thereof that is secured in the boundary region and an outer end thereof that is positioned in a preselected position relative to the panel and the secured panel.

In another of its aspects, the invention provides a mullion assembly for securing one or more first panels in a predetermined position relative to one or more second panels on a building structure between the building structure and an external space. The mullion assembly includes a first mullion segment of the first panel, a second (secured) mullion segment of the second panel installed on the building structure, and one or more thermal insulator elements. The first mullion segment includes an elongate first main portion extending between inner and outer ends thereof, and an elongate first inner portion attached to the first main portion at the inner end and extending substantially orthogonally from the main portion, the first inner portion defining an inner aperture therein. The first mullion segment also includes a first outer portion attached to the first main portion at the outer end and extending substantially orthogonally from the main portion, the first outer portion defining an outer aperture therein. The first panel includes a first glazing unit secured to the first outer portion and at least partially positioned between the external space and the first outer portion. The second (secured) mullion segment includes an elongate second main portion extending between inner and outer ends thereof, and an elongate second inner portion attached to the second main portion at the inner end and extending substantially orthogonally from the main portion, the second inner portion comprising an inner peg at least partially receivable in the inner aperture of the first inner portion. The second mullion segment also includes a second outer portion attached to the second main portion at the outer end and extending substantially orthogonally from the main portion, the second outer portion comprising an outer peg at least partially receivable in the outer aperture. The second panel also includes a second glazing unit secured to the second outer portion and at least partially positioned between the external space and the second outer portion. Upon the inner peg and the outer peg being at least partially received in the inner and outer apertures respectively, to attach the first and second inner portions together and to attach the first and second outer portions together respectively, the first and second mullion segments are attached to each other, securing the first panel in the predetermined position relative to the building structure, and defining a central cavity in which a central volume of air is isolated for at least partially thermally insulating the building structure relative to the external space, the first and second outer portions collectively defining a boundary region between the central cavity and the exterior space. The thermal insulator element is at least partially positionable between the first panel and the second panel, to at least partially define the thermal break(s) between the external space and the boundary region.

In yet another aspect, the mullion assembly additionally includes a cover element attached to the thermal insulator element. The cover element is formed to engage preselected portions of each of the first and second glazing units upon the attachment of the first and second mullion segments to each other to at least partially define the thermal break(s) between the external space and the boundary region.

In another aspect, the thermal insulator element alternatively includes an external engagement portion engageable with the first panel and the second panel to at least partially define the thermal break(s) between the external space and the boundary region.

In another of its aspects, the invention provides a transverse mullion assembly for securing a first panel in a preselected position relative to a second (secured) panel on a building structure between the building structure and an external space. The transverse mullion assembly includes a first transverse mullion segment, a second (secured) transverse mullion segment, a gasket, and one or more transverse thermal insulator elements. The first transverse mullion segment is included in a first panel unit that is to be attached to a second panel unit, the second panel unit having previously been secured to the building structure, and to one or more other panel units. The second transverse mullion segment is included in the second (secured) panel unit. The first transverse mullion segment includes an elongate first main transverse portion extending between inner and outer ends thereof. The first main transverse portion includes a first body segment having first front and rear walls and one or more first side walls at least partially defining a transverse central region in which a transverse central volume of air is isolated for thermally insulating the building structure relative to the external space. The first transverse mullion segment also includes a first outer portion attached to the first main transverse portion at the outer end and extending substantially orthogonally from the first main transverse portion. The first outer portion and the front wall define a slot therebetween. The first panel includes a first glazing unit secured to the first outer portion and at least partially positioned between the external space and the first outer portion. The second transverse mullion segment includes an elongate second main transverse portion extending between inner and outer ends thereof. The second main transverse portion includes a second body segment having second front and rear walls and one or more second side walls at least partially defining a second central region in which a second central volume of air is isolated for thermally insulating the building structure relative to the external space. The second body segment includes a second outer portion positioned outwardly relative to the second central region. The second transverse mullion segment also includes an arm subassembly attached to the second main transverse portion and having an arm extending substantially orthogonally from a base of the arm subassembly secured to the second side wall of the second main transverse portion, the arm being at least partially receivable in the slot in a secured position in which the arm is sealably engaged with the first outer portion and the first front wall. The second panel includes a second glazing unit secured to the second outer portion and at least partially positioned between the external space and the second outer portion.

The gasket is at least partially positionable between the first and second transverse mullion segments between the arm and the external space when the arm is in the secured position in the slot to at least partially thermally insulate the building structure relative to the external space. When the arm is in the secured position in the slot, the first and second outer portions and the arm define a separation region between the transverse central region and the external space. The transverse thermal insulator element is at least partially positionable between the first and second panels, to at least partially define one or more thermal breaks between the external space and the separation region.

In another of its aspects, the transverse mullion assembly is at least partially secured between first and second mullion segments.

In yet another of its aspects, the invention provides an intermediate mullion assembly for securing an upper panel and a lower panel relative to a building structure between the building structure and an external space. The intermediate mullion assembly includes an intermediate body defining an intermediate cavity therein in which air is isolated for at least partially thermally insulating the building structure relative to the external space. The intermediate body is securable to the upper and lower panels. The intermediate mullion assembly also includes one or more intermediate thermal insulator elements at least partially positionable between the upper and lower panels, to at least partially define one or more thermal breaks between the external space and the intermediate body.

In another aspect, the invention provides a jamb mullion assembly for securing a panel in a selected position relative to a building structure between the building structure and an external space. The jamb mullion assembly includes a jamb mullion body defining a jamb mullion cavity therein in which air is isolated for at least partially thermally insulating the building structure relative to the external space. The panel includes a glazing unit that is secured to the jamb mullion body and extending from a preselected side of the jamb body. The jamb mullion body additionally includes a closed side that is secured to the building structure.

In yet another aspect, the invention provides a method of securing a first panel unit in a predetermined position relative to a building structure between the building structure and an external space. The method includes engaging a first mullion segment with a substantially vertical second mullion segment, to attach the first and second mullion segments to each other to define a central cavity therein at least partially defined by a boundary region in which a central volume of air is isolated for thermally insulating the building structure relative to the external space. (The second mullion segment is included in a second panel unit that is attached to the building structure, being previously secured thereto, and to one or more panels.) One or more thermal insulator elements are positioned between the boundary region and the external space, for thermally insulating the building structure relative to the external space. While the first mullion segment is attached to the second mullion segment, a first transverse mullion segment is engaged with a substantially horizontal second transverse mullion segment, to attach the first and second transverse mullion segments to each other to provide a transverse central region in which a transverse central volume of air is substantially isolated to at least partially insulate the building structure relative to the external space, the engaged first and second transverse mullion segments defining a separation region between the building structure and the external space. Also, one or more transverse thermal insulator elements are positioned between the separation region and the external space, for thermally insulating the building structure relative to the external space.

BRIEF DESCRIPTION OF THE DRAWINGS

The invention may be better understood with reference to the attached drawings, in which.

DETAILED DESCRIPTION

Figure 1A:
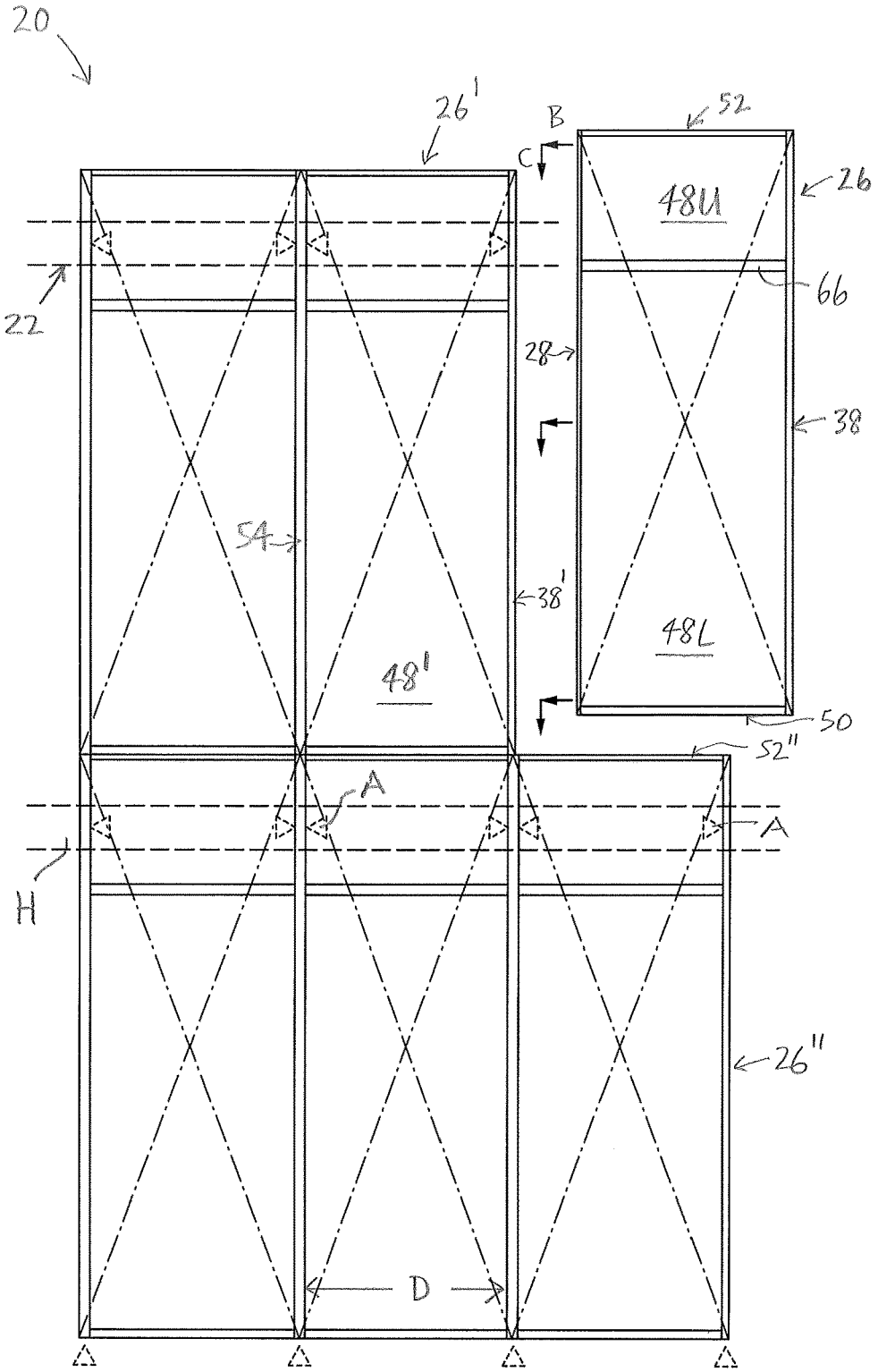
FIG. 1A is a front view of an embodiment of a curtain wall system of the invention, partially installed on a building structure.
Figure 1B:
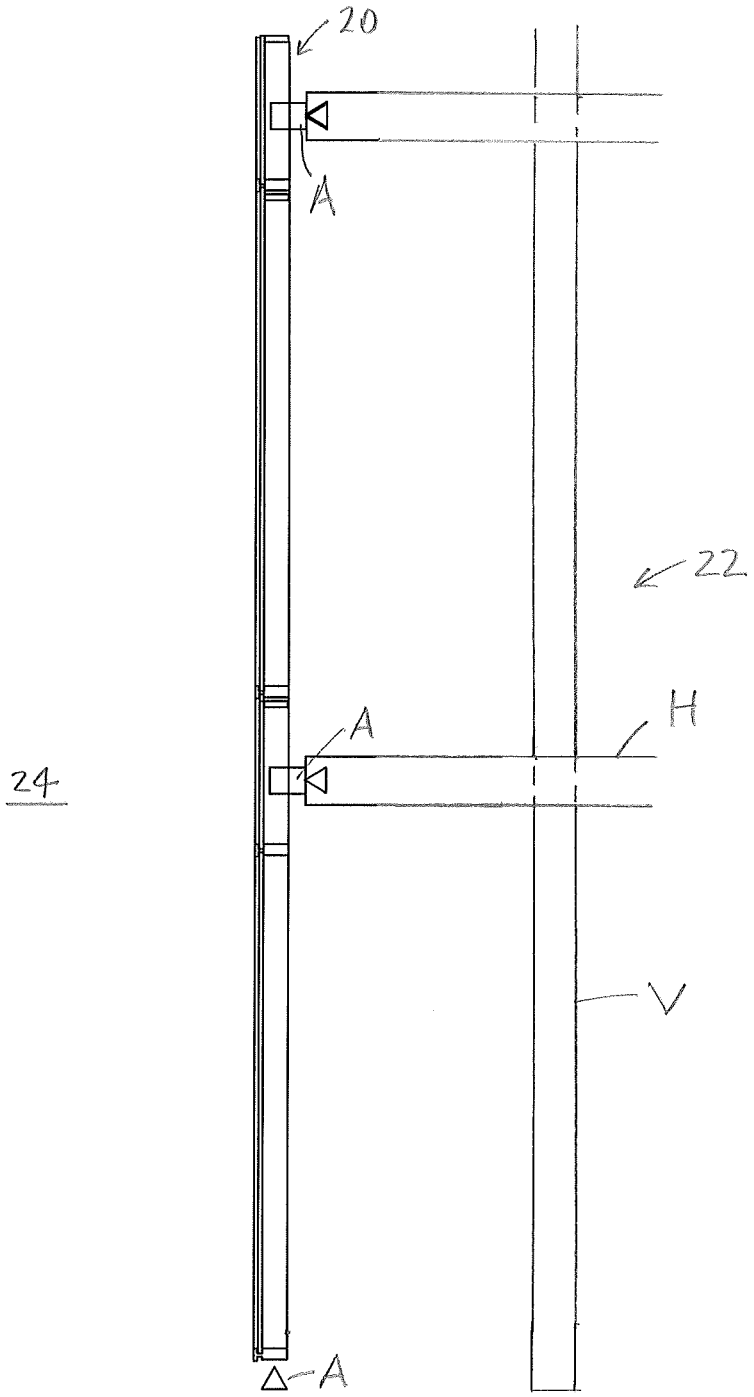
FIG. 1B is a schematic side view of the curtain wall system of FIG. 1A and the building structure on which the curtain wall system is partially installed.
Figure 2A:
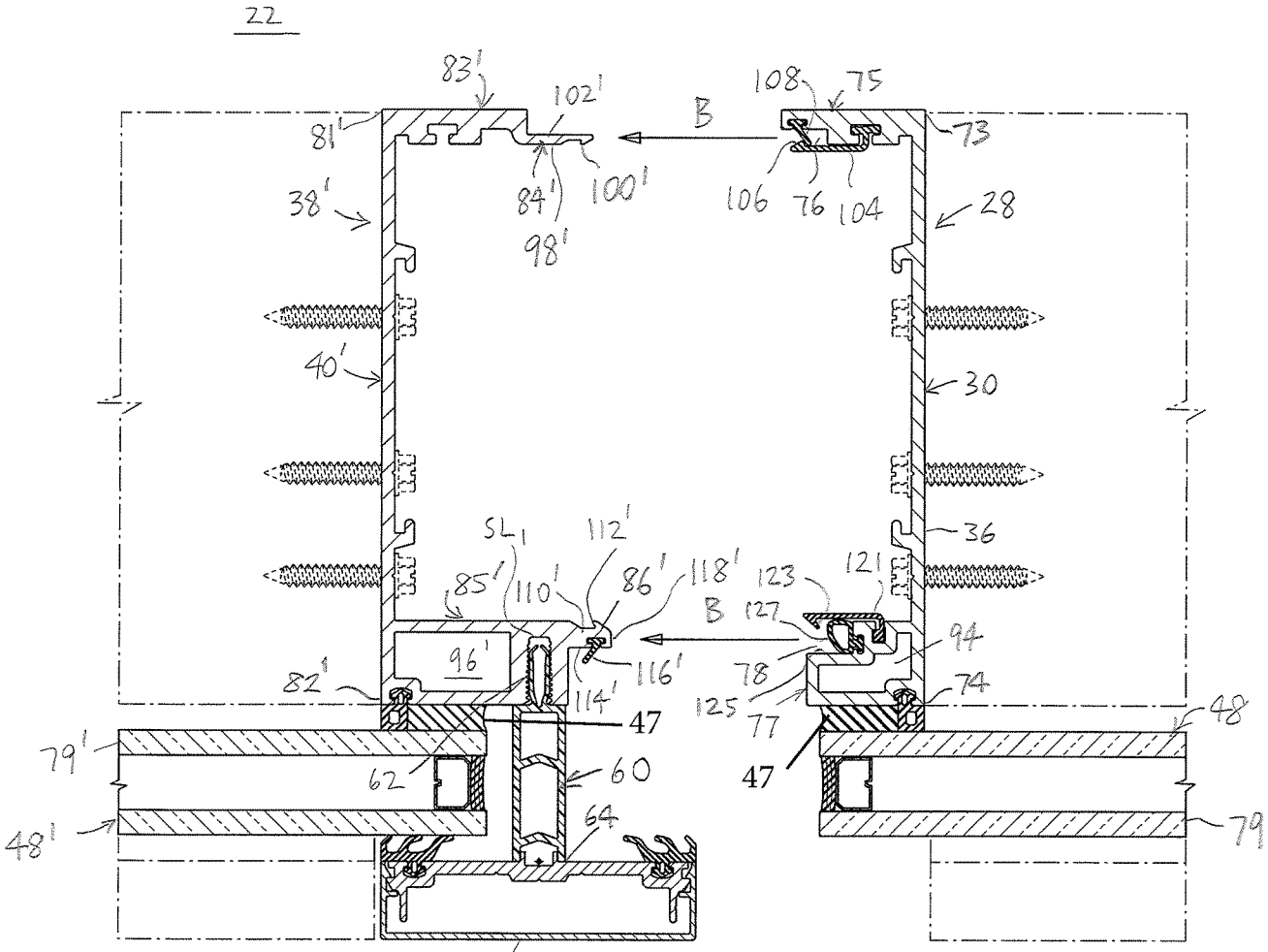
FIG. 2A is a cross-section of an embodiment of a mullion assembly of the invention prior to installation thereof, drawn at a larger scale.
Figure 9A:
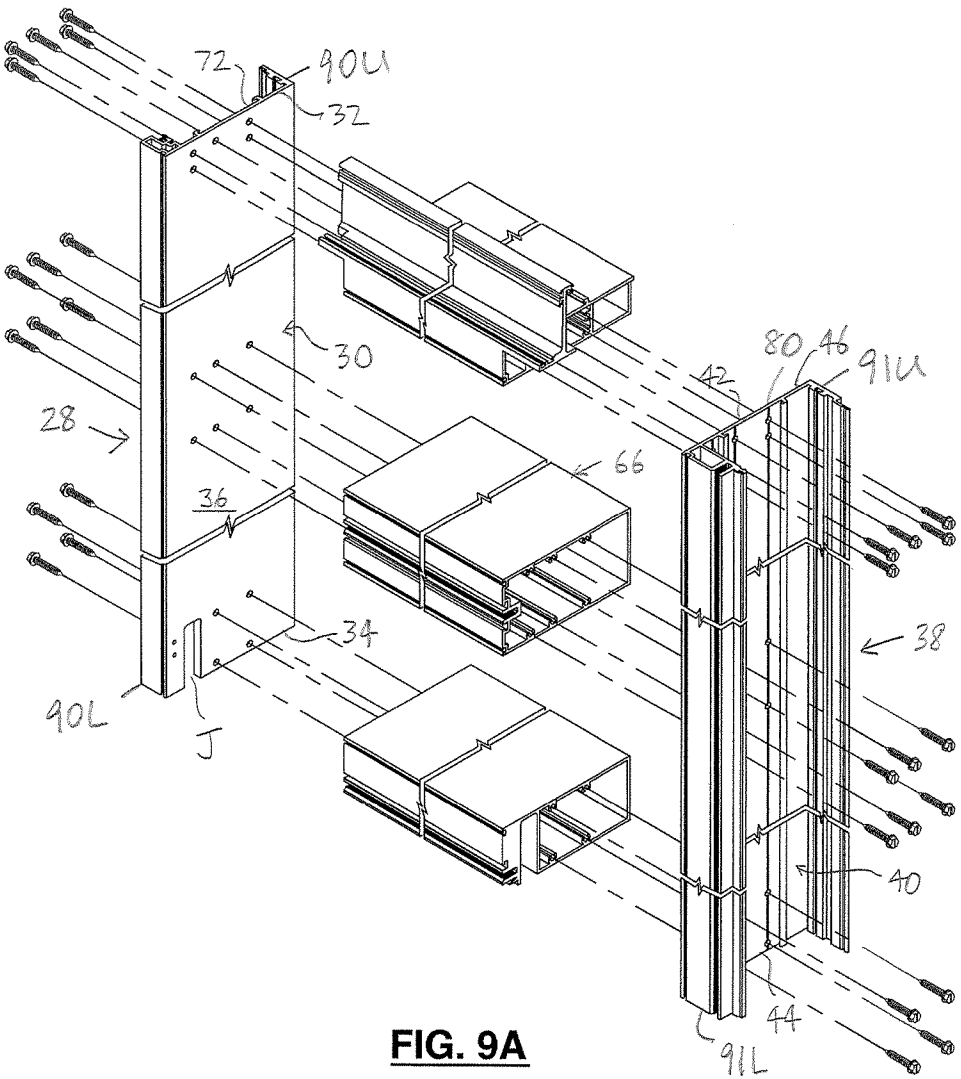
FIG. 9A is an exploded isometric view of an embodiment of a panel unit of the invention from which certain elements have been omitted, drawn at a smaller scale.

In the attached drawings, like reference numerals designate corresponding elements throughout. Reference is first made to FIGS. 1A-5B and 9A-10B to describe an embodiment of a curtain wall system in accordance with the invention indicated generally by the numeral 20. As will be described, the curtain wall system 20 preferably is secured to a building structure 22 (FIGS. 1A, 1B) between the building structure 22 and an external space 24 (FIG. 1B) relative thereto. In one embodiment, and as can be seen in FIGS. 1A and 3, the curtain wall system 20 preferably includes a plurality of panel units 26 attachable to each other respectively. Preferably, each panel unit 26 includes a first mullion segment 28, having an elongate first main portion 30 extending between first top and bottom ends 32, 34 thereof and including a first exterior side 36 thereof (FIGS. 2A, 9A), and a second mullion segment 38, having an elongate second main portion 40 extending between second top and bottom ends 42, 44 thereof and including a second exterior side 46 thereof (FIGS. 2A, 9A). As will also be described, each panel unit 26 preferably also includes one or more panels 48 positioned between the first and second mullion segments 28, 38 (FIGS. 1A, 2A-3).

Figure 3:
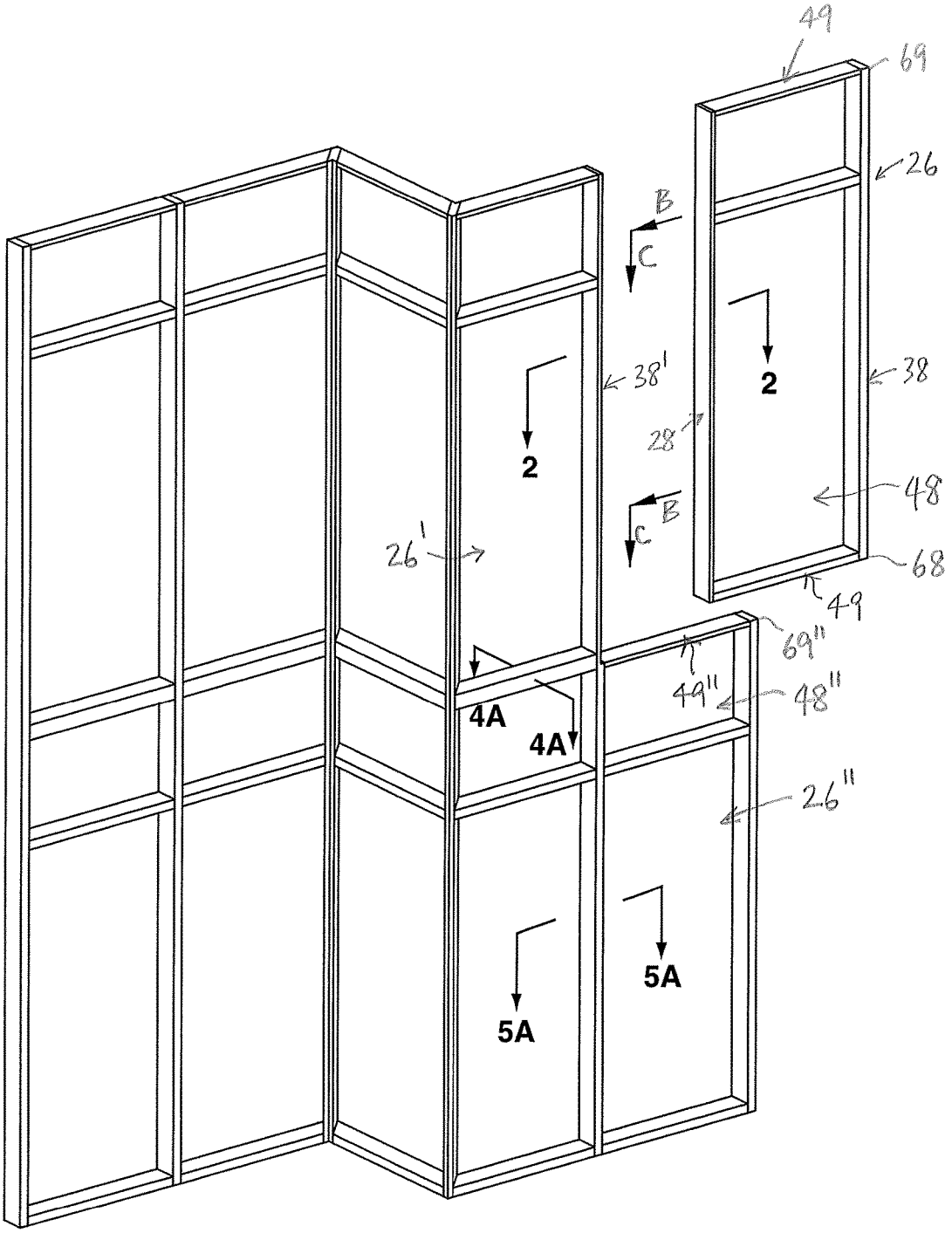
FIG. 3 is an isometric view of an alternative embodiment of the curtain wall system of the invention showing an unattached panel unit in position to be attached to other panel units of the system, drawn at a smaller scale.
Figure 4A:
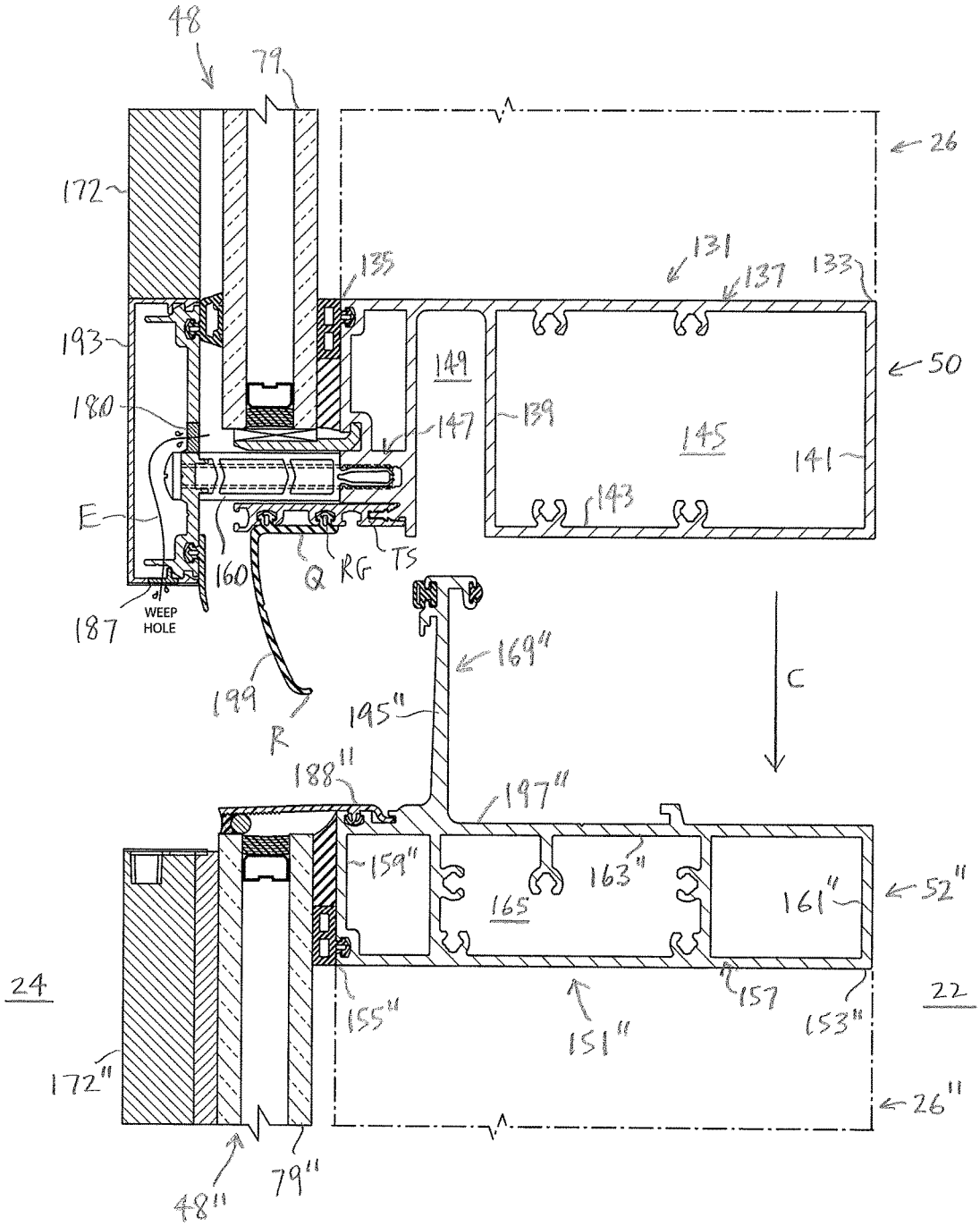
FIG. 4A is a cross-section of first and second transverse mullion segments of the invention prior to their attachment to each other to form a transverse mullion assembly of the invention, drawn at a larger scale.
Figure 4B:
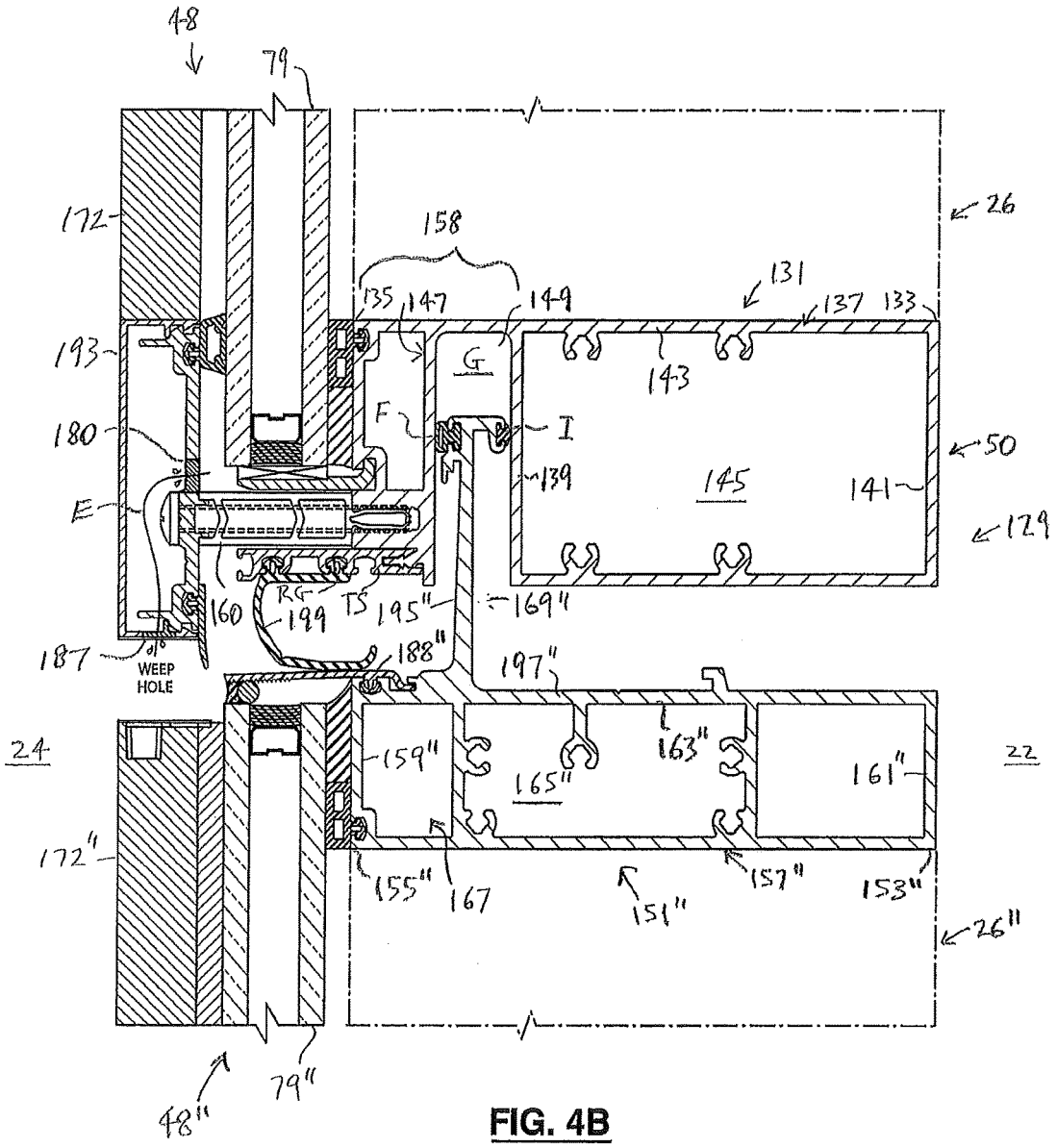
FIG. 4B is a cross-section of the transverse mullion assembly of the invention formed by the attachment of the first and second transverse mullion segments of FIG. 4A with each other.

It is also preferred that each panel unit 26 includes one or more transverse mullion segments 49 (FIG. 3). The transverse mullion segment 49 included in the panel unit 26 preferably is selected from the group consisting of the first and second transverse mullion segments 50, 52 (FIGS. 4A, 4B). Such transverse mullion segment 49 preferably is secured between the first and second exterior sides 36, 46 of the first and second main portions 30, 40 to locate the first and second main portions 30, 40 spaced apart from each other by a preselected distance "D" (FIGS. 1A, 3). It is also preferred that the panel 48 is held between the first and second mullion segments 28, 38 and the transverse mullion segment(s) 49 (FIG. 3).

Figure 5A:
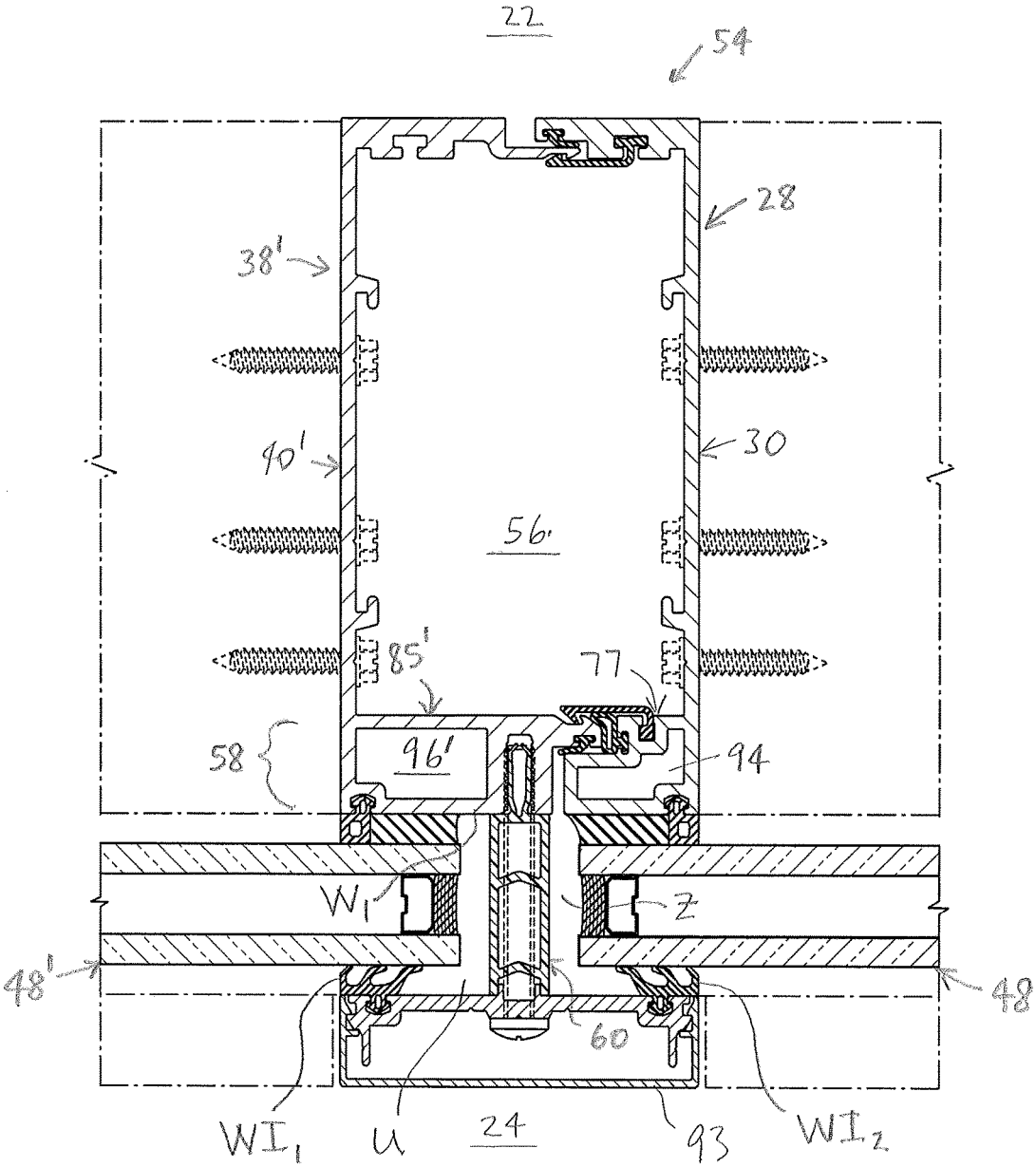
FIG. 5A is a cross-section of another embodiment of the mullion assembly of the invention.

Preferably, the first mullion segment 28 of each panel unit 26 is attachable to a secured second mullion segment 38' of a first installed panel unit 26' (FIGS. 1A, 3), to provide a mullion assembly 54 defining a central cavity 56 therein in which a central volume of air is isolated for at least partially thermally insulating the building structure 22 relative to the external space 24, as will also be described (FIG. 5A). The installed panel unit 26' preferably includes a secured panel 48' (FIG. 1A). As will also be described, when they are attached together, the first and secured second mullion segments 28, 38' additionally define a boundary region 58 between the external space 24 and the central cavity 56 (FIG. 5A). It is also preferred that, as can be seen in FIG. 5A, each mullion assembly 54 includes one or more thermal insulator elements 60 at least partially positioned between the panel 48 and the secured panel 48' to at least partially define one or more thermal breaks "U", "Z" between the external space 24 and the boundary region 58.

It will be understood that the thermal insulation or thermal break provided by various elements of the invention described herein retards the passage of heat therethrough. Accordingly, references herein to "thermal insulation" or a "thermal break" or variants thereof will be understood to be references to thermal insulation that may permit transfer of some heat therethrough. Also, it will be understood that references herein to a volume of air being "isolated" mean that the volume of air is generally dead, and generally not subjected to movement thereof or drafts, but also that the volume of isolated air or portions thereof may be subjected to movement or drafts from time to time, i.e., the isolation of the volume of air is not necessarily complete.

As can be seen in FIG. 5A, in one embodiment, the thermal breaks "U" and "Z" preferably are located on opposite sides of the thermal insulator element 60. The thermal breaks "U" and "Z" are air spaces in which air is isolated. In the embodiment illustrated in FIG. 5A, the thermal breaks "U" and "Z" preferably extend between the boundary region 58 and a cover element 93. In FIG. 5A it can be seen that, partly because of wiper elements "$WI_1$" and "$WI_2$" that are positioned between the respective panels 48, 48' and the cover element 93, the air spaces "U" and "Z" are isolated.

As can be seen in FIGS. 1A and 3, once the panel unit 26 is installed, the first installed panel unit 26' is positioned beside the panel unit 26. As illustrated in FIGS. 1A and 1B, the curtain wall system 20 preferably is secured to the building structure 22 by a number of anchors "A", as is known in the art. It will be understood that the illustrations of the anchors in FIGS. 1A and 1B are symbolic representations, and details of the anchors "A" have been omitted for clarity of illustration. Because the anchors "A" are conventional, no further description thereof is required.

The building structure 22 illustrated in FIG. 1B is also conventional, and typically includes vertical members "V" connected with horizontal members "H" (FIGS. 1A, 1B). Those skilled in the art would appreciate that the horizontal members typically include floors in the building, or support the floors, and that the building would include numerous elements (e.g., for HVAC, and other services) that are not shown for clarity of illustration. Further details of the building structure relating to the floors and other elements are omitted from FIG. 1B for clarity of illustration. Those skilled in the art would also appreciate that the building structure 22 illustrated in FIG. 1B is exemplary only, and that the building structure 22 may have any suitable configuration.

Those skilled in the art would also appreciate that the design of the panel units 26 as illustrated in FIGS. 1A and 3 is also exemplary only. As illustrated, in one embodiment, the panel unit 26 preferably includes an upper panel 48U and a lower panel 48L, divided by an intermediate mullion assembly 66. As will be described, and as can be seen in FIGS. 1A and 3, in each panel unit 26, the intermediate mullion assembly 66 preferably is secured between the first and second mullion segments 28, 38.

It can also be seen in FIG. 1A that, when the panel unit 26 is installed, the upper panel 48U preferably is positioned proximal to the horizontal member "H" of the building structure 22. It will be understood that the upper panel 48U may be opaque, or partially opaque, so that the horizontal member "H" and building elements associated therewith are not viewable (or, not easily viewable) from the external space 24, once the curtain wall system 20 is installed. In one embodiment, although the upper panel 48U preferably is opaque or partially opaque, the lower panel 48L preferably has any suitable appearance. The lower panel 48L may have any suitable appearance, e.g., it may be translucent, or clear, or combinations thereof.

Those skilled in the art would appreciate that the design of the panel units 26 may take many forms. The specific design of the panel units 26 that is illustrated (i.e., with upper and lower panels 48U, 48L, and the intermediate mullion assembly 66 positioned therebetween) is only one example of the design of the panel unit 26. For clarity of illustration, however, only one design of the panel unit 26 is shown in the drawings herewith.

Figure 2B:
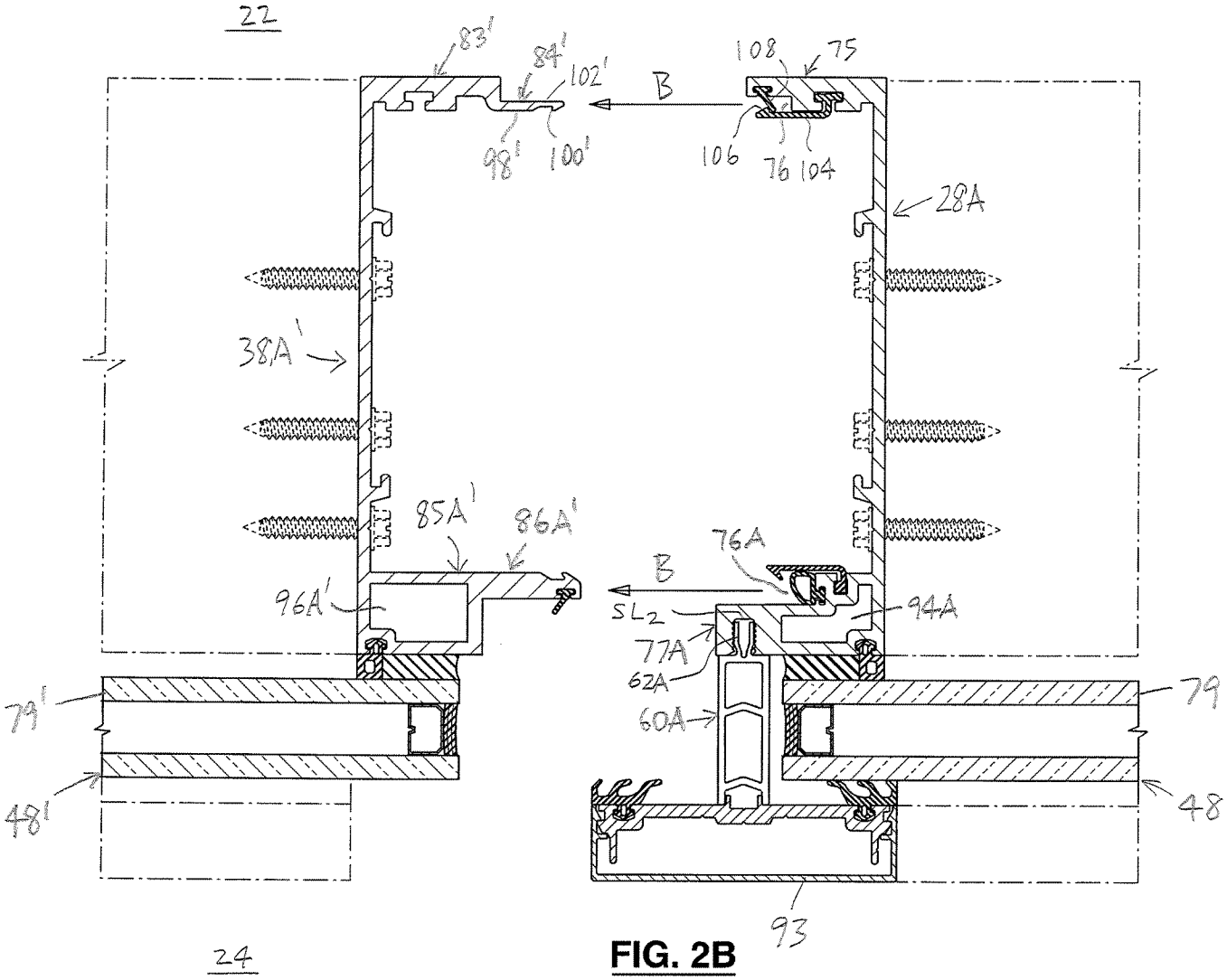
FIG. 2B is a cross-section of an alternative embodiment of the mullion assembly of the invention, prior to installation thereof.

As can be seen in FIGS. 2A, 2B, and 5A, in one embodiment, the curtain wall system 20 preferably includes the cover element 93. In this embodiment, the wiper elements "$WI_1$" and "$WI_2$", which are included in the cover element 93, sealably engage the panels 48, 48' respectively.

Figure 5B:
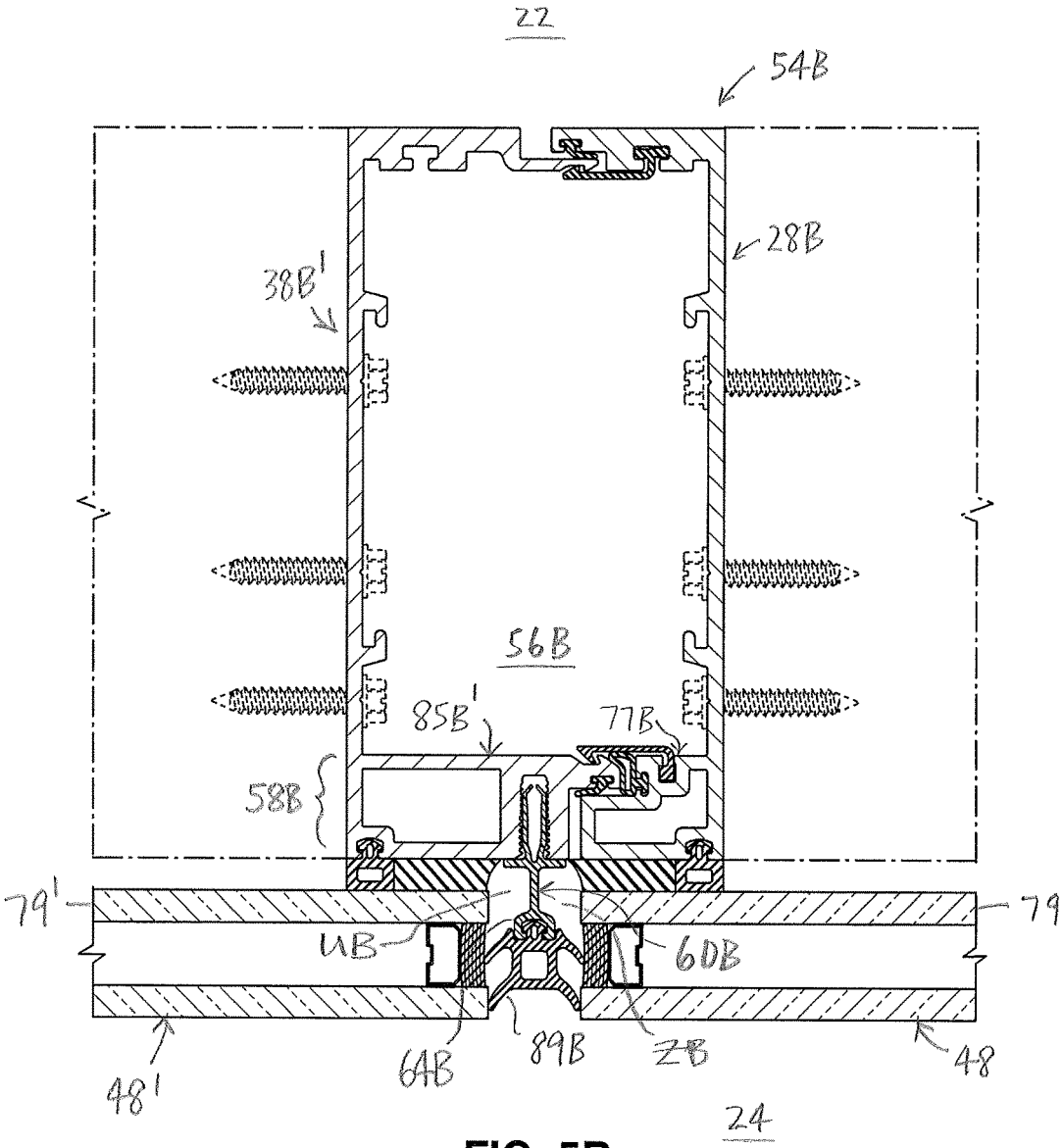
FIG. 5B is a cross-section of another embodiment of the mullion assembly of the invention.

An alternative embodiment, illustrated in FIG. 5B is described further below. In the alternative embodiment of FIG. 5B, air spaces "UB" and "ZB" are partially defined by a thermal insulator element 60B, in the absence of the cover element. The air spaces "UB" and "ZB" contain isolated air volumes therein. As can be seen in FIGS. 2A, 2B, 5A, and 5B, in one embodiment, it is preferred that the thermal insulator element 60 extends between an inner end 62 thereof that is secured in the boundary region 58 and an outer end 64 thereof that is positioned in a preselected position relative to the panel 48 and the secured panel 48' (FIG. 2A). The thermal insulator element 60 is positioned to at least partially insulate the boundary region 58 relative to the external space 24. As can be seen in FIG. 5A, when the thermal insulator element 60 is attached to the cover element 93, the thermal insulator element 60 at least partially defines the air spaces "U" and "Z", in which air is isolated.

From the foregoing, it can be seen that the preselected position of the outer end of the thermal insulator element varies and the outer end may have different configurations, depending on the embodiment of the mullion assembly. In the embodiment illustrated in FIG. 5A, the preselected position in which the outer end 64 is located is outwardly relative to the panels 48, 48', and the cover element 93 is secured to the outer end 64 of the thermal insulator element 60. However, in the embodiment illustrated in FIG. 5B, the outer end of the thermal insulator element is formed to engage each of the panels 48, 48', and the outer end is positioned generally between the panels, as will be described.

As can be seen in FIG. 5A, when the first and second mullion segments 28, 38' are joined together, the central cavity 56 is defined, in which air is isolated. The isolated air in the central cavity 56 serves to at least partially thermally insulate the building structure 22 relative to the external space 24. Also, the boundary region 58 provides support for the thermal insulator element 60 extending outwardly therefrom to define the additional isolated air spaces "U" and "Z" that are located between an outer element (in FIG. 5A, the cover element 93) and the boundary region 58. These additional isolated air spaces provide additional thermal insulation between the external space 24 and the building structure 22, i.e., in addition to the isolated air in the central cavity 56.

In addition, in one embodiment, the boundary region 58 preferably includes the pockets 96' and 94 of isolated air (FIGS. 2A, 2B). These isolated air pockets provide additional thermal insulation.

It can also be seen in FIG. 5A that the structure of the boundary region 58, with the thermal insulator element 60 extending therefrom toward the external space 24, provides substantial flexibility to the designer, because different external elements (e.g., the cover element 93) may be secured to the boundary region 58 without materially affecting the effectiveness of the thermal insulation provided by the joined mullion segments. The cover element 93 may be provided in a wide variety of forms, and in each case, thermal breaks "U" and "Z" may be defined between the cover element 93 and the boundary region 58.

In one embodiment, illustrated in FIG. 2A, the second outer portion 85' preferably includes a slot "$SL_1$" in which the inner end 62 of the thermal insulator element 60 is securely receivable. In another embodiment, illustrated in FIG. 2B, the inner end 62A of the thermal insulator element 60A preferably is securely receivable in a slot "$SL_2$" that is formed in the first outer portion 77A. Accordingly, it can be seen that the boundary region 58 is defined by an outer wall "$W_1$" when the mullion segments are joined together, and the thermal insulator element 60 is mounted, at its inner end, in the outer wall "$W_1$" (FIG. 5A).

Also, as noted above, the thermal insulator element 60 may be provided in various forms. For example, one alternative design is illustrated in FIG. 5B, in which the thermal insulator element is exposed to the external space 24, in the absence of a cover element, as will be further described below.

From the foregoing, it can be seen that the design of the mullion assembly, in which the thermal insulator element extends outwardly from the outer wall "$W_1$" of the boundary region to partially define additional thermal breaks outwardly from the boundary region, i.e., between the boundary region and the external space, provides both the additional thermal breaks and flexibility regarding whether a cover element is used, and if used, the design of the cover element. Accordingly, the system herein enables the designer to have a number of options regarding the appearance of the installed curtain wall system.

The components of the system 20, and in particular of the mullion assembly 54, may be made of any suitable materials. However, it is preferred that the thermal insulator element is made of material or materials having low thermal conductivity properties. For example, suitable materials would be synthetic plastic polymers and/or polyamide materials. Those skilled in the art would otherwise generally be aware of suitable materials.

It is preferred that the transverse mullion segment 49 on the panel unit 26 is attachable to a cooperating transverse mullion segment 49", selected to cooperate therewith, on a second installed panel unit 26", as will also be described (FIG. 3). As can be seen in FIGS. 1A and 3, once the panel unit 26 is installed, the second installed panel unit 26" is positioned below the panel unit 26. The second installed panel unit 26" preferably includes a second installed panel 48", as will also be described. As can be seen in FIG. 3, the transverse mullion segment 49 preferably is positioned at a bottom end 68 of the panel unit 26. The cooperating transverse mullion segment 49" preferably is positioned at a top end 69" of the second installed panel unit 26".

As can be seen in FIGS. 1A and 3, to install the panel unit 26, it is first moved substantially horizontally (i.e., in the direction indicated by arrow "B" in FIGS. 1A and 3), to engage the first mullion segment 28 of the panel unit 26 with the second mullion segment 38' of the first installed panel unit 26', so that the first and second mullion segments 28, 38' are attached to each other to at least partially form the mullion assembly 54, as illustrated in FIG. 5A. However, it will be understood that when the first and second mullion segments 28, 38' are first attached to each other, they are not horizontally aligned, because the panel unit 26 is above the first installed panel unit 26' at that point. Once the first mullion segment 28 and the second mullion segment 38' are engaged, the panel unit 26 is then moved downwardly (i.e., in the direction indicated by arrow "C" in FIGS. 1A and 3), with the first and second mullion segments 28, 38' remaining slidably engaged, to engage the transverse mullion segment 49 at the bottom end 68 of the panel unit 26 with the cooperating transverse mullion segment 49" at the top end 69" of the second installed panel unit 26". That is, while the first mullion segment 28 and the second mullion segment 38' remain slidably attached to each other, the first mullion segment 28 is moved downwardly relative to the second mullion segment 38'. The downward movement of the panel unit 26 that is being installed is stopped when the transverse mullion segment 49 at the bottom end 68 engages the cooperating transverse mullion segment 49" at the top end 69" of the second installed panel unit 26".

As illustrated, the panel unit 26 preferably includes the first mullion segment 28 on a left side 70 thereof, and the second mullion segment 38 preferably defines a right side 71 of the panel unit 26. However, those skilled in the art would appreciate that, alternatively, the second mullion segment 38 could define the left side 70 of the panel unit 26, and the first mullion segment 28 could define the right side 71. Those skilled in the art would also appreciate that any such alternative arrangement would need to be consistent with the arrangements of the installed panel units to which the panel unit is attached.

It can also be seen that, as illustrated in FIG. 3, the transverse mullion segment 49 that defines the bottom end 68 of the panel unit 26 preferably is the first transverse mullion segment 50. In this arrangement, it will be understood that the cooperating transverse mullion segment 49" that cooperates with the transverse mullion segment 49 preferably is the second transverse mullion segment 52" (FIG. 1A). As can be seen in FIGS. 1A and 3, the cooperating transverse mullion segment 49" defines the top end 69" of the second installed panel unit 26". In this arrangement, it is preferred that the top end 69 of the panel unit is defined by the second transverse mullion segment 52, as can be seen in FIG. 1A.

It will be understood that, in the embodiment illustrated in FIG. 1A, the panel unit (not shown) that is to be installed above the panel unit 26 (i.e., with its bottom end engaging the top end 69 of the panel unit 26) preferably includes a transverse mullion segment that is formed to cooperate with the transverse mullion segment 52 positioned at the top end 69 of the panel unit 26.

As noted above, it is preferred that the first mullion segment 28 (i.e., included in the panel unit 26) and the second (secured) mullion segment 38' (i.e., included in the installed panel unit 26') are attachable together to form the mullion assembly 54 (FIG. 5A). The mullion assembly 54 is for securing one or more first panels 48 in a predetermined position relative to one or more second installed panels 48' on the building structure 22, positioned between the building structure 22 and the external space 24. In one embodiment, the mullion assembly 54 preferably includes the first mullion segment 28 of the first panel, which includes the elongate first main portion 30, which extends between inner and outer ends thereof 73, 74 (FIG. 2A). As can be seen in FIG. 2A, the first mullion segment 28 preferably also includes an elongate first inner portion 75 attached to the first main portion 30 at the inner end 73 and extending substantially orthogonally from the first main portion 30, the first inner portion 75 preferably defining an inner aperture 76 therein. It is also preferred that the first mullion segment 28 includes a first outer portion 77 attached to the first main portion 30 at the outer end 74 and extending substantially orthogonally from the first main portion 30, the first outer portion 77 defining an outer aperture 78 therein. As can also be seen in FIG. 2A, the first panel 48 preferably includes a first glazing unit 79 that is secured to the first outer portion 77 by adhesive 47 and is at least partially positioned between the external space 24 and the first outer portion 77 when the mullion assembly 54 is assembled (FIGS. 2A, 5A). The adhesive 47 is secured directly to the first glazing unit 79 and the adhesive 47 is secured directly to the first outer portion 77.

In one embodiment, the mullion assembly 54, which is formed when the first and second (secured) mullion segments 28, 38' are attached to each other, preferably also includes the secured second mullion segment 38' of the second panel, which includes the elongate second main portion 40' extending between inner and outer ends 81', 82' thereof, and an elongate second inner portion 83' attached to the second main portion 40' at the inner end 81' and extending substantially orthogonally from the second main portion 40'. Preferably, the second inner portion 83' includes an inner peg 84' at least partially receivable in the inner aperture 76 of the first inner portion 75 (FIGS. 2A, 5A). The second mullion segment 38' preferably also includes a second outer portion 85' attached to the second main portion 40' at the outer end 82' and extending substantially orthogonally from the second main portion 40', the second outer portion 85' including an outer peg 86' at least partially receivable in the outer aperture 78. Preferably, the second panel 48', which includes a second glazing unit 79', is secured directly to the second outer portion 85' by adhesive 47 and at least partially positioned between the external space 24 and the second outer portion 85' (FIGS. 2A, 5A). The adhesive 47 is secured directly to the second glazing unit 79' and the adhesive 47 is secured directly to the second outer portion 85'.

In one embodiment, it is preferred that the inner peg 84' and the outer peg 86' are at least partially receivable in the inner and outer apertures 76, 78 respectively, to attach the first and second inner portions 75, 83' together, and to attach the first and second outer portions 77, 85' together respectively, so that the first and second mullion segments 28, 38' are attached to each other, securing the first panel 48 in the predetermined position relative to the building structure 22, and defining the central cavity 56 (FIG. 5A) in which a central volume of air is isolated for at least partially thermally insulating the building structure 22 relative to the external space 24. Preferably, the first and second outer portions 28, 38' collectively define the boundary region 58 between the central cavity 56 and the external space 24.

As described above, it is also preferred that the mullion assembly 54 includes one or more thermal insulator elements 60 at least partially positionable between the first and second panels 48, 48', to at least partially define the thermal breaks "U", "Z" between the external space 24 and the boundary region 58. Those skilled in the art would appreciate that the thermal breaks "U", "Z" that are at least partially defined by the thermal insulator element(s) 60 thermally insulate between the boundary region 58 and the external space 24. As can be seen in FIG. 5A, the thermal breaks "U", "Z" that are at least partially defined by the thermal insulator element(s) 60 improve the thermal insulation provided by the mullion assembly 54 overall.

Those skilled in the art would appreciate that, in the alternative, the first mullion segment 28 may be included in a panel that is installed on the building structure (i.e., the panel designated above as the "second" panel), and the second mullion segment 38' may be included in another panel that is to be installed on the building structure (i.e., the panel designated above as the "first" panel).

It will also be understood that, in an alternative embodiment, a panel unit may include two first (i.e., female) mullion segments, and another panel unit formed for engagement therewith may include two second (i.e., male) mullion segments. Those skilled in the art would appreciate that these alternative embodiments of the panel units may be desirable, depending on the circumstances at a particular installation of the curtain wall system of the invention.

As noted above, in one embodiment, the thermal insulator element 60 preferably extends between the boundary region 58 and an external element that is exposed to or engages with the external region 24. For instance, in FIG. 5A, the external element is the cover element 93. In that embodiment, the thermal breaks "U" and "Z" are defined between the contact element 93 and the boundary region 58, as well as by the thermal insulator element 50. In another embodiment illustrated in FIG. 5B, the thermal insulator element 60 is itself exposed to or engages with the external region 24. As can be seen in FIG. 5B, the thermal insulator element 60B preferably includes an external engagement portion 89B that is located at the outer end of the thermal insulator element 60B and is positioned between, and engaged with, the panels 48, 48'. That is, in the absence of the cover element, the thermal breaks "UB", "ZB" are defined by the thermal insulator element 60B and the boundary region 58B.

As can be seen in FIG. 2A, in the embodiment illustrated, the second mullion segment 38' is included in the first installed panel unit 26', which is stationary. Preferably, the first mullion segment 28 is moved in the direction indicated by the arrow "B" in FIGS. 1A and 2A to engage the first mullion segment 28 with the second mullion segment 38'.

It will be understood that the second mullion segment 38 defining the right side 70 of the panel unit 26 includes elements that are the same as the elements described above and included in the second mullion segment 38'. For example, the second main portion 80 of the second mullion segment 38 is illustrated in FIG. 9A.

In an alternative embodiment of the mullion assembly 54A illustrated in FIG. 2B, the thermal insulator element 60 preferably is mounted in the first outer portion 77A. It will be understood that the first mullion segment 28A is moved in the direction indicated in FIG. 2B by arrows "B" to engage with, and become attached to, the second mullion segment 38A. Except for the location of the thermal insulator element 60 on the first mullion segment and the consequent changes in the outer portions 77A, 85A, the elements in FIG. 2B are substantially the same as the corresponding elements in FIG. 2A.

As noted above, FIG. 9A is an exploded view of certain elements of the panel unit 26. As can be seen in FIG. 9A, the first mullion segment 28 and the second mullion segment 38 preferably extend between respective top ends 90U, 91U and bottom ends 90L, 91L thereof (It will be understood that certain elements of the panel unit 26, e.g., the panels 48U, 48L have been omitted from FIG. 9A for clarity of illustration.)

Figure 9B:
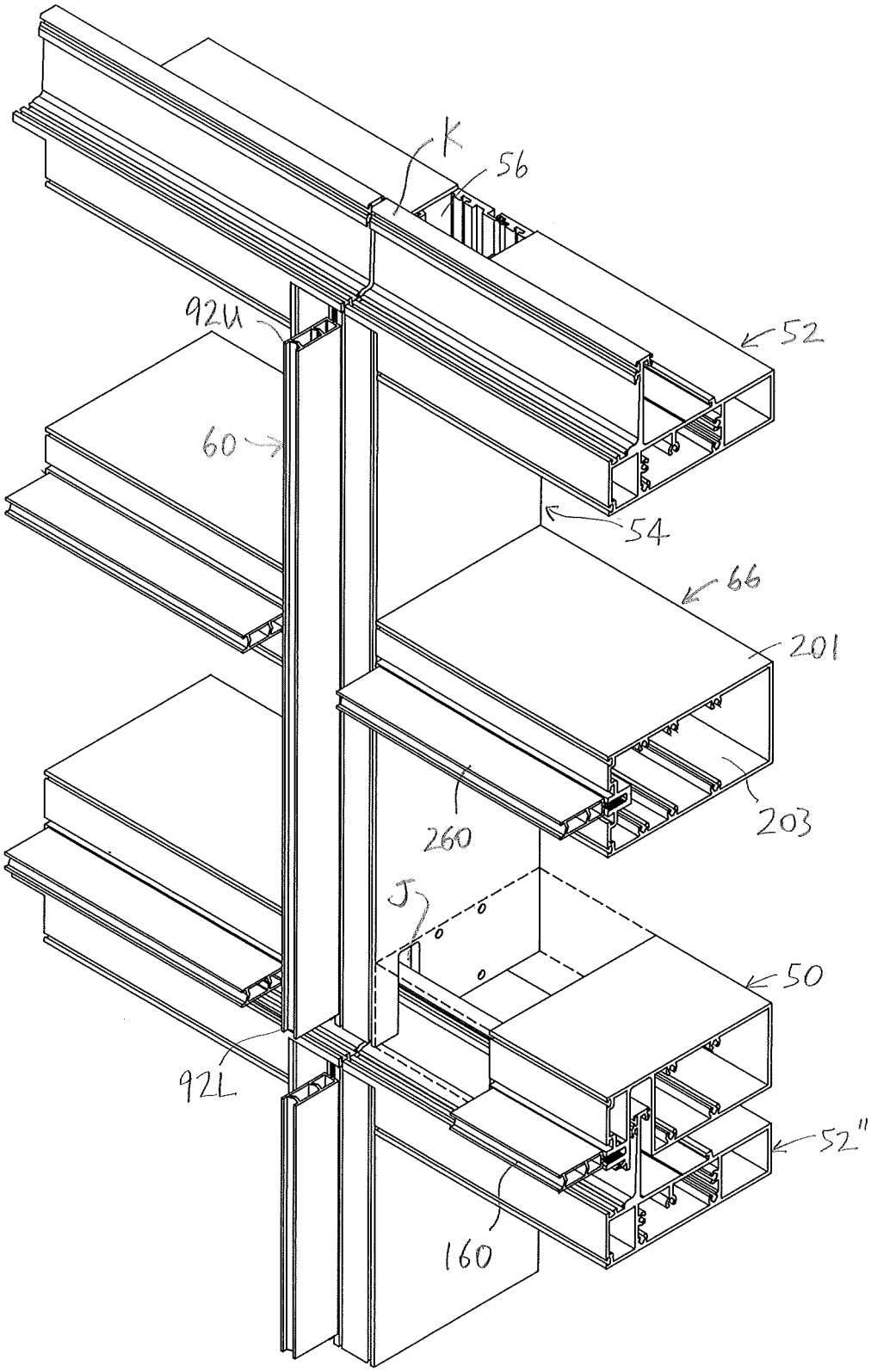
FIG. 9B is an isometric view of portions of an embodiment of the mullion assembly of the invention as assembled, with transverse mullion assemblies and intermediate mullion assemblies secured thereto, drawn at a larger scale.

As can be seen in FIG. 9B, when the mullion assembly 54 is assembled, the thermal insulator element 60 preferably extends between upper and lower ends thereof 92U, 92L proximal to the respective top ends and bottom ends of the attached first and second mullion segments 28, 38' respectively.

As noted above, the panel units 26 may be formed according to various designs, depending on, among other things, the overall appearance of the curtain wall system 20 that is sought to be achieved. In one embodiment, it is preferred that the mullion assembly 54 additionally includes the cover element 93 that is attached to the thermal insulator element 60. As can be seen in FIGS. 2A, 2B, and 5A, the cover element 93 preferably is formed to engage preselected portions of each of the first and second glazing units 48, 48' upon the attachment of the first and second mullion segments 28, 38' to each other to at least partially define the thermal breaks "U", "Z" between the external space 24 and the boundary region 58. It can be seen in FIGS. 2A and 2B that the inner end 62 of the thermal insulator element 60 may be secured to the second inner portion 85' (FIG. 2A) or to the first inner portion 77 (FIG. 2B). If the mullion assembly 54 includes the cover element 93, then the cover element 93 may be included in the first mullion segment 28 or the second mullion segment 38'.

Alternatively, the mullion assembly may not include a cover element, as noted above. In an alternative embodiment illustrated in FIG. 5B, the mullion assembly 54B of the invention does not include the cover element. In this embodiment, the thermal insulator element 60B preferably includes the external engagement portion 89B engageable with the first and second panels 48, 48' to at least partially define the thermal breaks "UB", "ZB" between the external space 24 and a boundary region 58. The external engagement portion 89B preferably is located at an outer end 64B of the thermal insulator element 60B. Preferably, the external engagement portion 89B includes wiper elements "$WI_3$" and "$WI_4$" for sealably engaging the panels 48, 48' respectively. As can be seen in FIG. 5B, at least partially due to the wiper elements "$WI_3$", "$WI_4$", the isolated air spaces "UB" and "ZB" are formed once the mullion segments 28B, 38B' are joined together, to form the mullion assembly 54B. As can be seen in FIG. 5B, the mullion assembly 54B preferably is formed upon the attachment of the first and second mullion segments 28B, 38B' to each other. The first and second mullion segments 28B, 38B', when attached to each other, also define a central cavity 56B in which air is isolated, to thermally insulate the building structure 22 relative to the external space 24.

The outer portions 77B, 85B' define the boundary region 58B between the central cavity 56B and the thermal insulator element 60B. In order for the thermal insulator element 60B to provide the thermally insulative effect desired, the external engagement portion 89B preferably securely engages the panels 48, 48' when the segments 28B, 38B' are attached to each other.

Those skilled in the art would appreciate that, in addition to practical issues related to the engagement of the external engagement portion 89B with the panels 48, 48', the appearance of the external engagement portion 89B to an observer (not shown) in the external space may be important. Those skilled in the art would also appreciate that the external engagement portion 89B may be formed to have any desired appearance following installation. Accordingly, it can be seen from the foregoing that the mullion assembly 54B permits the designer to have a variety of finishes and colors and shapes in the external engagement portion 89B.

In addition, in FIG. 5A it can be seen that, in the embodiment of the mullion assembly 54 illustrated therein, the corner element 93 may have a variety of shapes and sizes. From the foregoing, it can be seen that the system 20 of the invention can readily be adapted to provide a variety of designs or appearances exposed to the external space.

From the foregoing, it can also be seen that the first and second mullion segments 28, 38' are formed to be attached together relatively easily, and the mullion assembly 54 that results provides good thermal insulation between the external space 54 and the building structure 22. In particular, the central cavity 56 provides good thermal insulation between the boundary region 88 and the building structure 22, and in addition, the thermal insulator element 60 partially defines one or more thermal breaks between the external space 24 and the boundary region 58.

In one embodiment, the mullion assembly 54 preferably includes a number of additional features that result in relatively good thermal insulation performance. Preferably, the first outer portion 77 includes a first cavity 94 therein that encloses a first volume of air therein for thermally insulating the central cavity 56 relative to the external space 24 (FIGS. 2A, 5A). As can be seen in FIGS. 2A, 2B, and 5B, it is also preferred that the second outer portion 85' additionally includes a second cavity 96 therein that encloses a second volume of air therein for thermally insulating the central cavity 56 relative to the external space 24. Preferably, the first volume of air in the first cavity 94 is at least partially isolated, so that it thermally insulates the central cavity 56 relative to the external space 24, to an extent. Similarly, the second volume of air in the second cavity 96 is also at least partially isolated. Advantageously, because of the first and second cavities 94, 96, the boundary region 58 in which these cavities 94, 96 are located preferably thermally insulates the central cavity 56 relative to the external space 24.

As can be seen in FIGS. 2A and 2B, it is preferred that the inner peg 84' has a first side 98' with a first catch 100' thereon and a substantially linear second side 102' opposed to the first side 98'. Also, the inner aperture 76, in which the inner peg 84' is receivable, is at least partially defined by a flexible first engagement clip 104 with an aperture catch 106 thereon positioned to engage the first side 98' of the inner peg 84', and a flexible second element 108 positioned to slidably engage the second side 102' of the inner peg 84'. Upon the inner peg 84' being inserted into the inner aperture 76 to a fully inserted position therein (FIG. 5B), the aperture catch 106 is engaged with the first catch 100' of the inner peg 84', to retain the inner peg 84' in the inner aperture 76, and the second element 106 slidably and sealably engages the second side 102 of the inner peg 84', to provide an inner seal between the central cavity 56 and the building structure 22. Because the aperture catch 106 on the first engagement clip 104 engages the first catch 100' when the inner peg 84' has reached its fully inserted position, the inner peg 84' is thereby retained in the inner aperture 76 to partially attach the first and second mullion segments 28, 38' together. Such at least partial inner seal, with an at least partial outer seal (described below) provided by the boundary region 58, substantially isolates air in the central cavity 56.

When the first and second mullion segments 28, 38' are attached, the first and second outer portions 77, 85' are secured together in a similar manner. In one embodiment, the outer peg 86' preferably includes an inner side 110' with an inner side catch 112' thereon and an opposed outer side 114' with an outer wiper blade 116' mounted thereon, the outer peg 86' extending to an end part 118' thereof. Preferably, the outer aperture 78 is at least partially defined by a flexible inner engagement clip 121 with a catch 123 thereon positioned to engage the inner side 110' of the outer peg 85', an outer wall 125 thereof, and a gasket 127 positioned between the flexible engagement clip 121 and the outer wall 125 (FIG. 2A). Although the gasket 127 preferably is a bulb gasket, it will be understood that other types of gaskets may be used. Upon the outer peg 86' being inserted into the outer aperture 78 to a fully inserted position therein (FIG. 5B), the catch 123 is engaged with the inner side catch 112' of the outer peg 86' to retain the outer peg 86' in the outer aperture 78, the outer wiper blade 116' engages the outer wall 125, and the end part 118' of the outer peg 85' engages the gasket 127, to provide at least the outer seal between the external space and the central cavity. Such outer seal is at least partial. As noted above, although the inner and outer seals may be only partial, they serve to substantially isolate air in the thermal cavity 56, to provide a thermal break therein.

As can be seen in FIG. 2B, the first and second outer portions 77A, 85A' differ somewhat from the first and second outer portions 77, 85' illustrated in FIG. 2A. Each of the outer portions 77A, 85A' preferably includes a respective cavity 94A, 96A'. When the first and second mullion segments are attached together to define a central cavity therebetween, the cavities 94A, 96A' thermally insulate the central cavity relative to the external space 24. The first outer portion 77A preferably includes an outer aperture 76A, and the second outer portion 85A' preferably includes an outer peg 86A'. It will be understood that, when the first and second mullion segments 28A, 38A' are attached together, the elements of the outer portions 77A, 85A' are engaged in the same manner as the corresponding elements of the outer portions 77, 85'. Because the elements, and the arrangements of the elements of the outer portions 77A, 85A' are generally the same as the corresponding elements of the outer portions 77, 85', further description of the elements of the outer portions 77A, 85A' is unnecessary.

The invention preferably includes a transverse mullion assembly 129 for securing the first panel 48 in the predetermined position relative to a second installed panel 48" on the building structure 22 between the building structure 22 and the external space 24. (The second installed panel 48" is included in the second installed panel unit 26".)

It will be understood that a first transverse mullion segment 50 is included in the first panel unit 26, which is to be installed by securing it to the second (previously installed) panel unit 26". It will also be understood that the panel unit 26" has previously been secured to the building structure 22 and to one or more other panel units. A second transverse mullion segment 52" is included in the second panel unit 26". As can be seen in FIG. 4B, when the first transverse mullion segment 50 and the second transverse mullion segment 52" are attached together, they form the transverse mullion assembly 129. As can be seen in FIG. 4A, in one embodiment, the first transverse mullion segment 50 preferably is moved substantially downwardly (i.e., in the direction indicated by arrow "C", in FIGS. 1A and 4A) to engage the first transverse mullion segment 50 with the second transverse mullion segment 52", to attach the two transverse mullion segments 50, 52" to each other, forming the transverse mullion assembly 129.

In one embodiment, as can be seen in FIGS. 4A and 4B, the first transverse mullion segment 50 preferably includes an elongate first main transverse portion 131 extending between inner and outer ends 133, 135 thereof. It is also preferred that the first main transverse portion 131 includes a first body segment 137 comprising first front and rear walls 139, 141 and one or more first side walls 143 at least partially defining a transverse central region 145 in which a transverse central volume of air is isolated for thermally insulating the building structure 22 relative to the external space 24. Preferably, the first transverse mullion segment 50 also includes a first outer portion 147 attached to the first main transverse portion 131 at the outer end 135 and extending substantially orthogonally from the first main transverse portion 131. The first outer portion 147 and the first front wall 139 preferably define a slot 149 therebetween (FIGS. 4A, 4B). In addition, the first panel 48 preferably includes the first glazing unit 79 that is secured to the first outer portion 147, and at least partially positioned between the external space 24 and the first outer portion 147.

It is also preferred that the transverse mullion assembly 129 includes the second transverse mullion segment 52", as can be seen in FIG. 4A. Preferably, the second transverse mullion segment 52" includes an elongate second main transverse portion 151" extending between inner and outer ends thereof 153", 155". The second main transverse portion 151" preferably also includes a second body segment 157" with second front and rear walls 159", 161" and one or more second side walls 163" at least partially defining a second central region 165" in which a second central volume of air is isolated for thermally insulating the building structure 22 relative to the external space 24. It is also preferred that the second transverse mullion segment 52" includes a second outer portion 167" positioned outwardly relative to the second central region 165". The second transverse mullion segment 52" preferably also includes an arm subassembly 169" attached to the second main transverse portion 151" and including an aim 195" extending substantially orthogonally from a base 197" of the arm subassembly 169" secured to the second side wall 163" of the second main transverse portion 151", the arm 195" being at least partially receivable in the slot 149 in a secured position in which the arm 195" is sealably engaged with the first outer portion 147 and the first front wall 139 (FIG. 4B). It is also preferred that the second panel 48", having a second glazing unit 79", is secured to the second outer portion 167" and at least partially positioned between the external space 24 and the second outer portion 167". Preferably, the transverse mullion assembly 129 also includes a second gasket 199 at least partially positionable between the first and second transverse mullion segments 50, 52" between the arm 195" and the external space 24 when the arm 195" is in the secured position in the slot 149 (FIG. 4B) to at least partially thermally insulate the building structure 22 relative to the external space 24.

It is also preferred that, when the arm 195" is in the secured position in the slot 149, the first and second outer portions 147, 167" and the arm 195" define a separation region 158 between the transverse central region 145 and the external space 24. The transverse mullion assembly 129 preferably also includes one or more transverse thermal insulator elements 160 at least partially positionable between the first and second panels 48, 48", to at least partially define one or mare thermal breaks "$ZT_1$" between the external space 24 and the separation region 158 (FIG. 4B).

As can be seen in FIGS. 4A and 4B, the first transverse mullion assembly 50 preferably includes a sill horizontal thermal shield "TS" that is secured to the first transverse outer portion 147. Preferably, the sill horizontal thermal shield "TS" is engaged with the first transverse outer portion 147 in a snap-fit engagement, for convenient assembly. It is also preferred that the gasket 199 is secured to the sill horizontal thermal shield "TS". In one embodiment, the gasket 199 preferably includes reglets "RG" that are securable in slots formed in the sill horizontal thermal shield "TS". In one embodiment, the gasket 199 preferably is acutely angled and extends from the sill horizontal thermal shield "TS" to engage an outer engagement portion 188" of the base 197" when the first and second transverse mullion segments 50, 52" are attached to each other. The gasket 199, as illustrated in FIG. 4A, is shown as extending from a secured end "Q" thereof that is secured to the sill horizontal thermal shield "TS" to an unsecured end "R" thereof that engages the outer engagement portion 188", when the first and second transverse mullion segments 50, 52" are attached to each other. Those skilled in the art would appreciate that, alternatively, the gasket 199 may be secured to the second transverse mullion segment, so that its unsecured end engages the first transverse outer portion when the first and second transverse mullion segments are attached to each other.

The sill horizontal thermal shield "TS" and the gasket 199 may be made of any suitable materials. It is preferred that the sill horizontal thermal shield "TS" is made of material or materials having low thermal conductivity properties. Preferably, the sill horizontal thermal shield "TS" is made of synthetic plastic polymers and/or polyamide materials. It is also preferred that the gasket 199 is made of suitably flexible and resilient materials. The gasket 199 preferably is made of EPDM (ethylene propylene diene monomer) rubber and/or silicone rubber materials. Those skilled in the art would otherwise generally be aware of suitable materials.

Figure 4C:
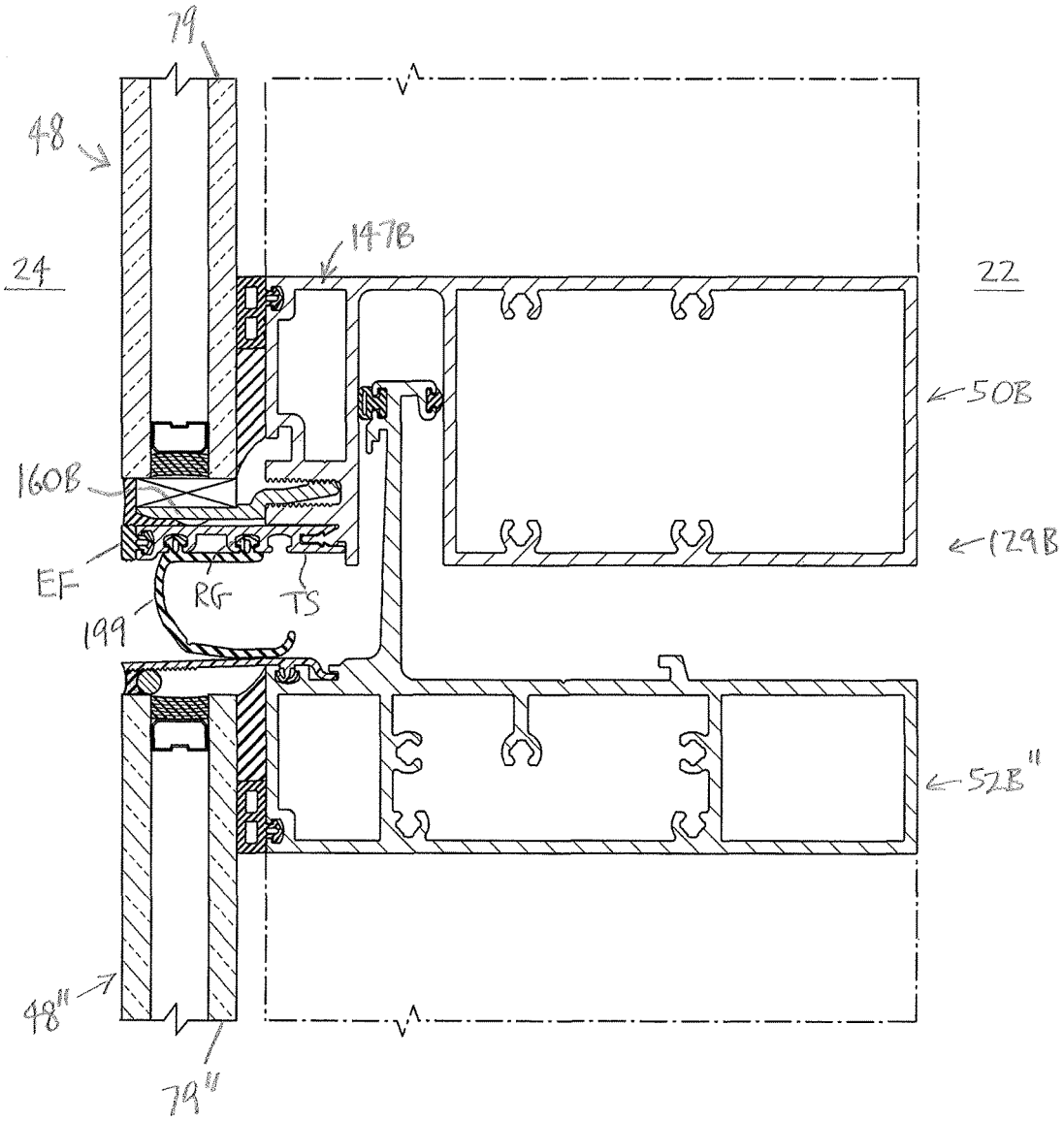
FIG. 4C is a cross-section of an alternative embodiment of the transverse mullion assembly of the invention.

In an alternative embodiment, illustrated in FIG. 4C, the sill horizontal thermal shield "TS" preferably includes an external fitting "EF" that is exposed to the external space 24. In this way, the same part (i.e., the sill horizontal thermal shield "TS") may be used in configurations in which it is not exposed (FIG. 4B) and, alternatively, in configurations in which it is exposed in part (FIG. 4C). It will be understood that the external fitting "EF" may have any suitable shape or appearance, and that wide varieties thereof are possible.

It can also be seen in FIGS. 4A and 4B that, in one embodiment, the first transverse mullion segment 50 preferably includes a cover element 193 that is secured to the thermal insulator element 160. As illustrated, the panels 48, 48" preferably also include respective trim elements 172, 172".

In one embodiment, the cover element 193 preferably also includes weep holes. As illustrated, the cover element 193 preferably includes first and second weep holes 180, 187. Those skilled in the art would appreciate that the weep holes 180, 187 permit water that has accumulated in the panel 48 to escape therefrom, under the influence of gravity, via a route that is schematically indicated by line "E" in FIG. 4B.

It is preferred that the transverse mullion assembly 129 is at least partially secured between the first and second mullion segments 28, 38 (FIGS. 9A, 9B). As noted above, the first and second mullion segments 28,38 preferably are included in the panel unit 26 (FIGS. 1A, 9A). In one embodiment, the first transverse mullion segment 50 of the transverse mullion assembly 129 preferably is secured between the first exterior side 36 of the first mullion segment 28 and the second exterior side 46 of the second mullion segment 38, i.e., in the panel unit 26 in which the first transverse mullion segment 50 is positioned. As can be seen in FIG. 9A, in one embodiment, the first transverse mullion segment 50 preferably is located at the bottom end 68 of the panel unit 26. (It will be understood that the upper and lower panels 48U, 48L are omitted from FIG. 9A for clarity of illustration.) It is also preferred that the second transverse mullion segment 52 (which is included in the panel unit 26) is secured between the first exterior side 36 of the first mullion segment 28 and the second exterior side 46 of the second mullion segment 38, i.e., in the panel unit 26 in which the second transverse mullion segment 52 is positioned. As shown in FIGS. 1A and 9A, in one embodiment, the second transverse mullion segment 52 preferably is located at the top end 69 of the panel unit 26.

As can be seen in FIG. 4B, the first and second transverse mullion segments 50, 52", when attached to each other, preferably are positioned so that there are gaps therebetween, to allow for thermal expansion of the components of the panel units. For example, a gap formed for this purpose in the slot 149 is identified in FIG. 4B as "G". As can be seen in FIGS. 4A and 4B, the arm 195" preferably includes seals "F" and "I" that sealably engage the first transverse outer portion 147 and the first front wall 139 respectively, for thermal insulation. It can therefore be seen in FIG. 4B that thermal expansion and contraction of elements of the panel units 26, 26" can be accommodated in the transverse mullion assembly 129. For instance, if the first and second transverse mullion segments 50, 52" are moved toward each other due to expansion, the arm 195" can move further into the slot 149, and the gasket 199 can be pressed further against the outer engagement portion 188", while maintaining the sealed and slidable engagement of the seals "F" and "I" in the slot 149 and the sealed engagement of the gasket 199 and the outer engagement portion 188".

An alternative embodiment of the transverse mullion assembly 129B of the invention is illustrated in FIG. 4C. In this embodiment, the transverse mullion assembly 129B does not include a cover element. Instead, a first transverse outer portion 147B preferably includes a thermal insulator element 160B located between the panels 48, 48". Otherwise, the first and second transverse mullion segments 50B, 52B" are generally the same as the first and second transverse mullion segments 50, 52" respectively.

Figure 10A:
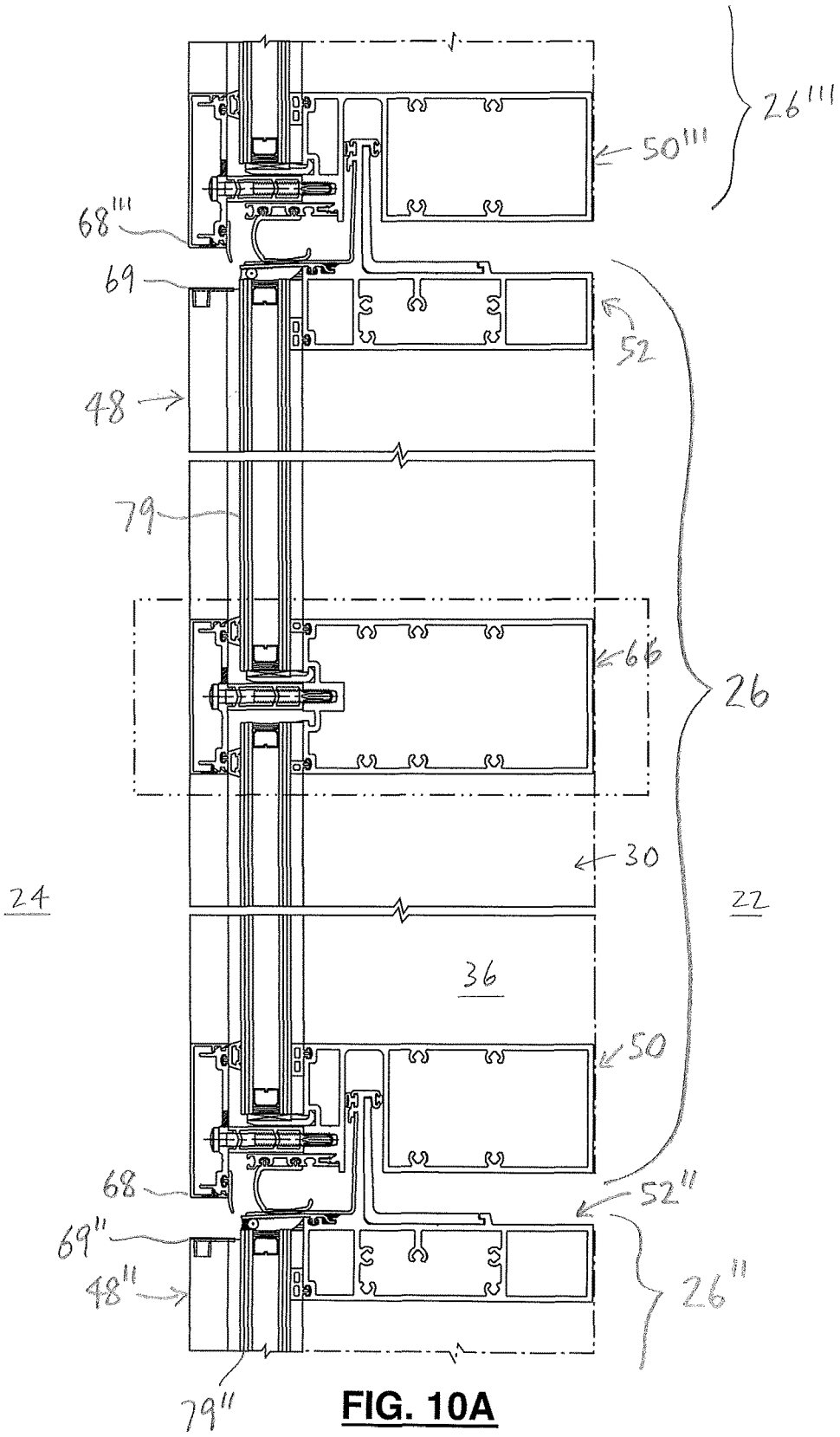
FIG. 10A is a side view of segments of the transverse mullion assemblies and the intermediate mullion assembly of FIG. 9A, drawn at a larger scale.
Figure 10B:
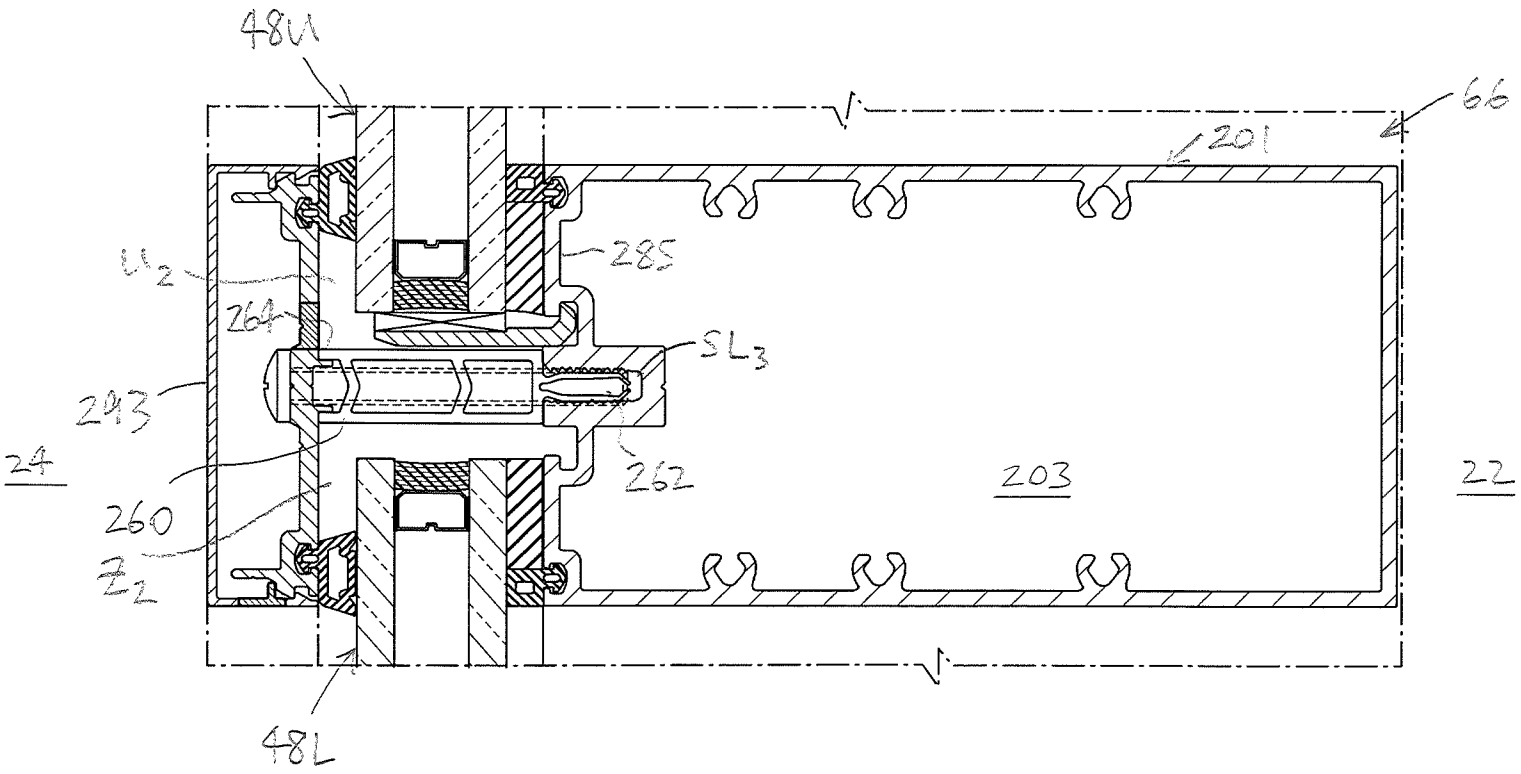
FIG. 10B is a cross-section of the intermediate mullion assembly of FIG. 10A, drawn at a larger scale.

As can be seen in FIGS. 1A, 9A, 9B, 10A, and 10B, in one embodiment, the panel unit 26 preferably includes the intermediate mullion assembly 66 for securing the upper panel 48U and the lower panel 48L relative to the building structure 22 and located between the building structure 22 and the external space 24. It is preferred that the intermediate mullion assembly 66 includes an intermediate body 201 defining an intermediate cavity 203 therein in which air is isolated for at least partially thermally insulating the building structure 22 relative to the external space 24. Preferably, the intermediate body 201 is at least partially positioned between the upper panel 48U and the lower panel 48L (FIGS. 1A, 10B). It is also preferred that the intermediate mullion assembly 66 includes one or more intermediate thermal insulator elements 260 at least partially positionable between the upper and lower panels 48U, 48L, to at least partially define one or more thermal breaks "$U_2$", "$Z_2$" between the external space 24 and the intermediate body 201 (FIG. 10B).

As can be seen in FIG. 10B, the cavity 203 is partially defined by an outer wall 285 in which a slot "$SL_3$" is formed. Preferably, an inner end 262 of the thermal insulator element 260 is secured in the slot "$SL_3$". In FIG. 10B, an outer end 264 of the thermal insulator element 260 is shown as being secured to a cover element 293. It is preferred that the cover element 293 includes wiper elements "$WI_5$", "$WI_6$" that sealably engage the panels 48U, 48L. However, similar to alternative embodiments described above, in an alternative embodiment, the thermal insulator element may be formed to at least partially define the isolated air spaces (thermal breaks), in the absence of a cover element.

As can be seen in FIG. 10B, the air spaces "$U_2$" and "$Z_2$" preferably are defined generally between the outer wall 285 and the cover element 293, beside the thermal insulator element 260. The isolated air in the air spaces "$U_2$", "$Z_2$" provides thermal insulation, to insulate the isolated air in the central cavity 203 relative to the external space 24, and therefore also insulating the building structure 22 relative to the external space 24.

Based on the foregoing description and the drawings, it can be seen that the intermediate mullion assembly 66 has a structure that readily permits adaptation thereof to various cover elements, or alternatively, to a version with no cover element. The thermal insulator element 260 is part of a thermally insulating structure between the external space 24 and the central cavity 203.

Those skilled in the art would appreciate that, when two of the second (lower) transverse mullion segments abut each other, it is preferred that additional elements are used for reinforcement, and also for alignment thereof. For example, as illustrated in FIGS. 11A and 11B, a left second transverse mullion segment 452 abuts a right second transverse mullion segment 552, i.e., after the respective panel units (not shown) in which the second transverse mullion segments 450, 452 are included have been installed, and are secured to the building structure 22.

Figure 11A:
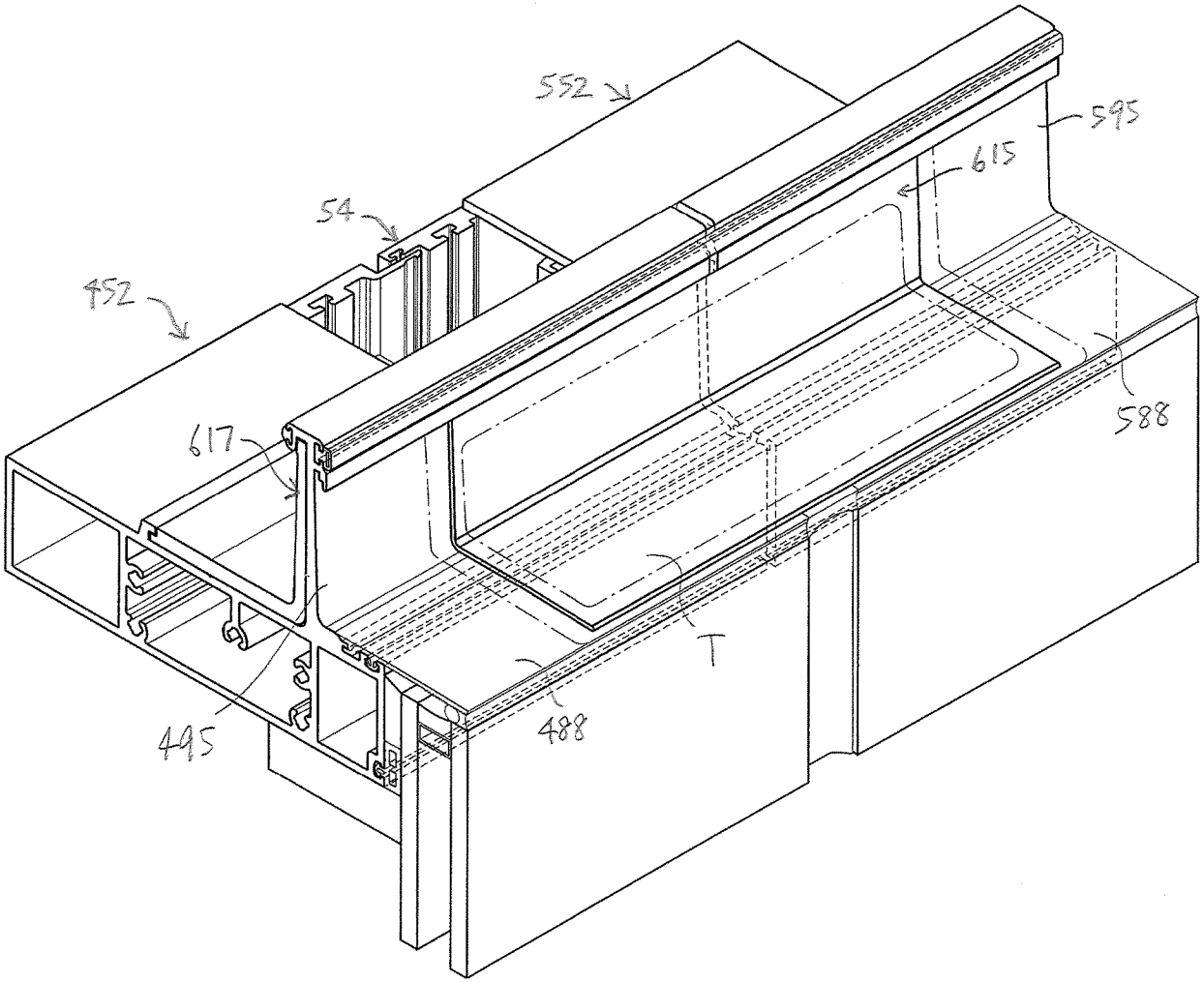
FIG. 11A is an isometric view of front sides of abutting second transverse mullion segments with a silicone splice sheet positioned thereon, drawn at a larger scale.
Figure 11B:
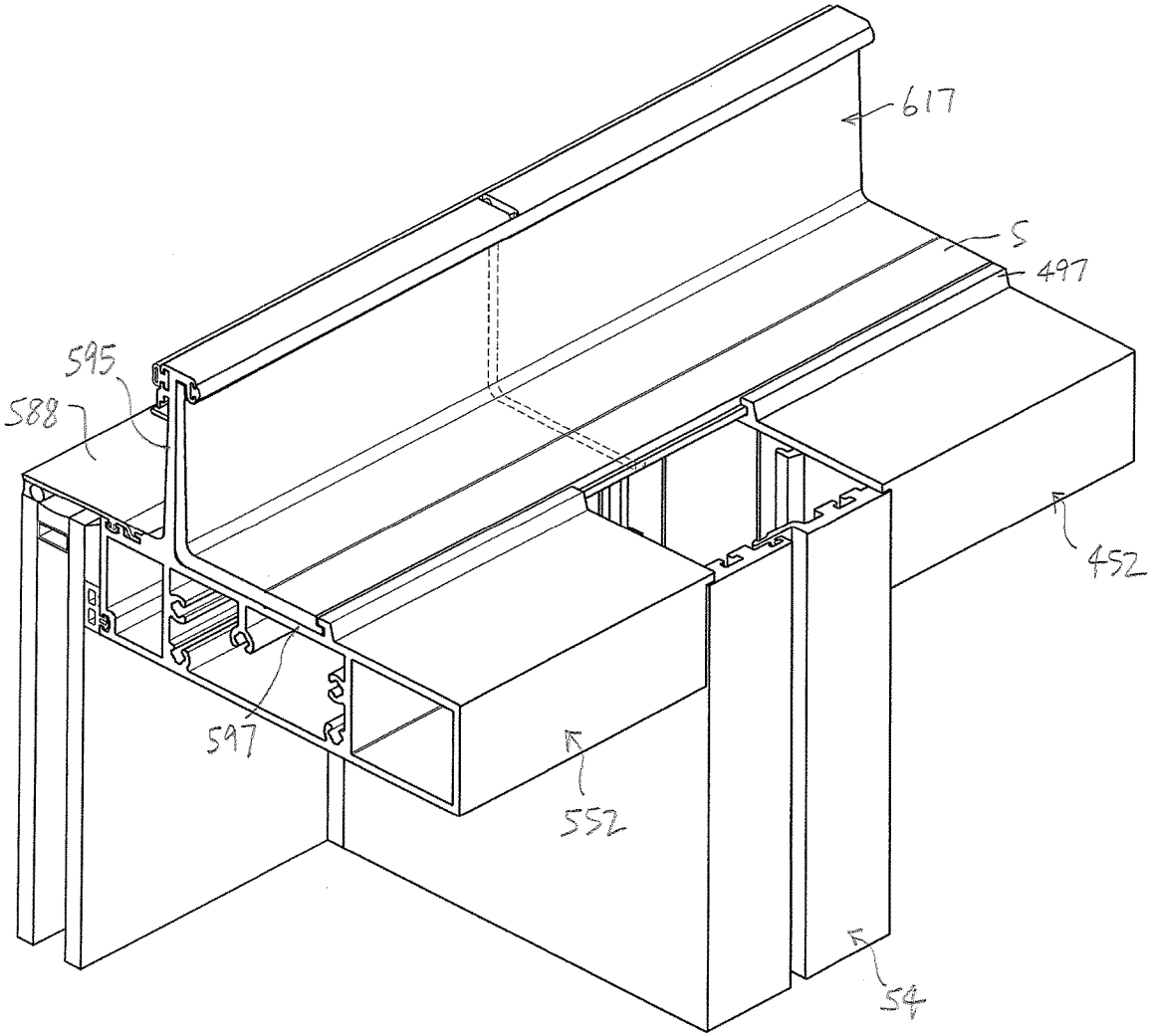
FIG. 11B is an isometric view of rear sides of the abutting second transverse mullion segments of FIG. 11A with a reinforcing and alignment angle element positioned thereon.

As can be seen in FIG. 11A, it is preferred that, once the abutting transverse mullion segments 452, 552 are in place, a silicone splice sheet 615 is located thereon, to overlap each of the transverse mullion segments 452. As can be seen in FIGS. 11A and 11B, the left and right second transverse mullion segments 452, 552 preferably include respective arms 495, 595. For the purposes hereof, the silicone splice sheet 615 is considered to be positioned at least in part on front sides of the arms 495, 595. As can also be seen in FIG. 11A, a lower portion "T" of the silicone splice sheet 615 is positioned on outer engagement portions 488, 588 of the respective second transverse mullion segments 452, 552.

Figure 11D:
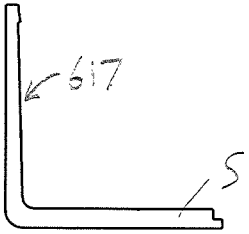
FIG. 11D is a side view of the reinforcing and alignment angle element of FIG. 11B.
Figure 11C:
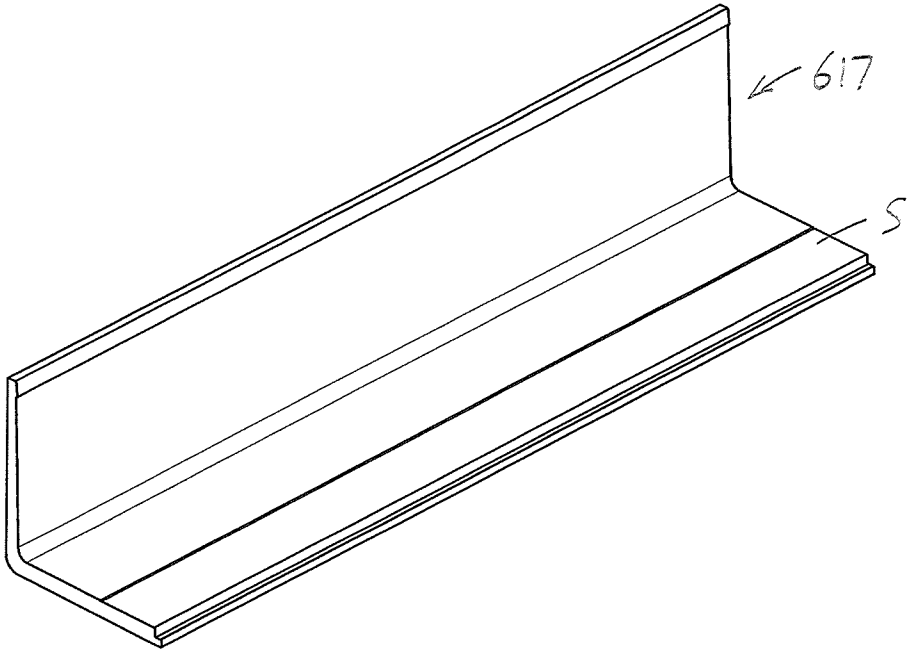
FIG. 11C is an isometric view of the reinforcing and alignment angle of FIG. 11B.

Similarly, a reinforcing and alignment angle element 617 preferably is positioned on the abutting transverse mullion segments 452, 552 behind (i.e., inwardly from) the respective arms 495, 595 of the second transverse mullion segments 452, 552. The reinforcing and alignment angle element 617 is illustrated in FIGS. 11C and 11D. As can be seen in FIGS. 11A and 11B, the reinforcing and alignment angle element 617 preferably is partially secured against rear sides of the arms 495, 595. The reinforcing and alignment angle element 617 preferably also includes a support portion "S" that engages the base regions 497, 597.

Figure 11E:
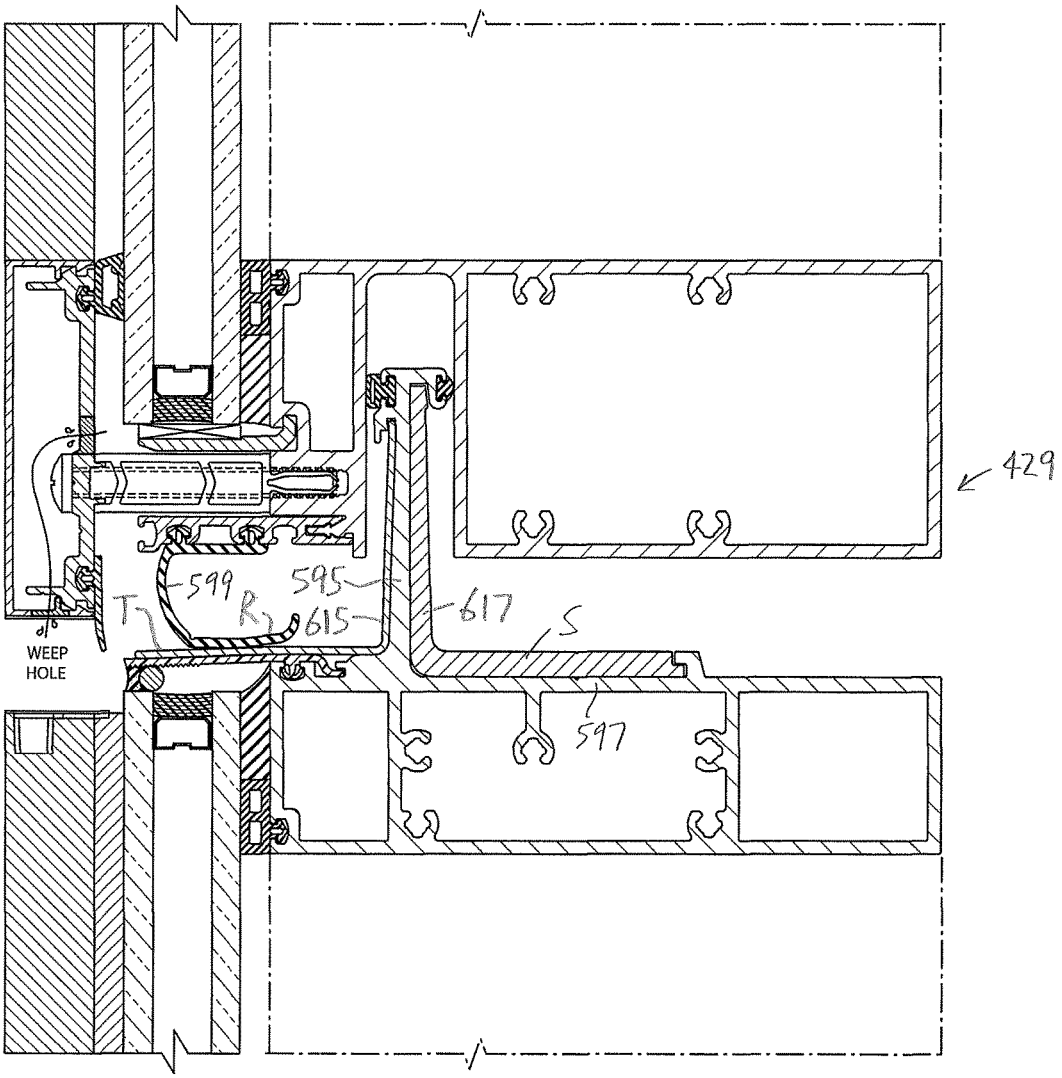
FIG. 11E is a cross-section of an embodiment of the second transverse mullion assembly of the invention including the silicone splice sheet of FIG. 11A and the reinforcing and alignment angle element of FIGS. 11B-11D.

After the silicone splice sheet 615 and the reinforcing and alignment angle element 617 are positioned on the left and right second transverse mullion segments 452, 552, the first transverse mullion segments generally corresponding thereto, that are included in panel units to be installed generally above the second transverse mullion segments 452, 552, are respectively lowered onto the second transverse mullion segments 452, 552, in the process described above. The manner in which the silicone splice sheet 615 and the reinforcing and alignment angle element 617 are included in the transverse mullion assembly 429 that is formed when the first and second transverse mullion segments 450, 452 are attached together is illustrated in FIG. 11E. As can be seen in FIG. 11E, the unsecured end "R" of the gasket 599 preferably engages the silicone splice sheet 615 when the first and second transverse mullion segments are attached to each other.

Figure 12:
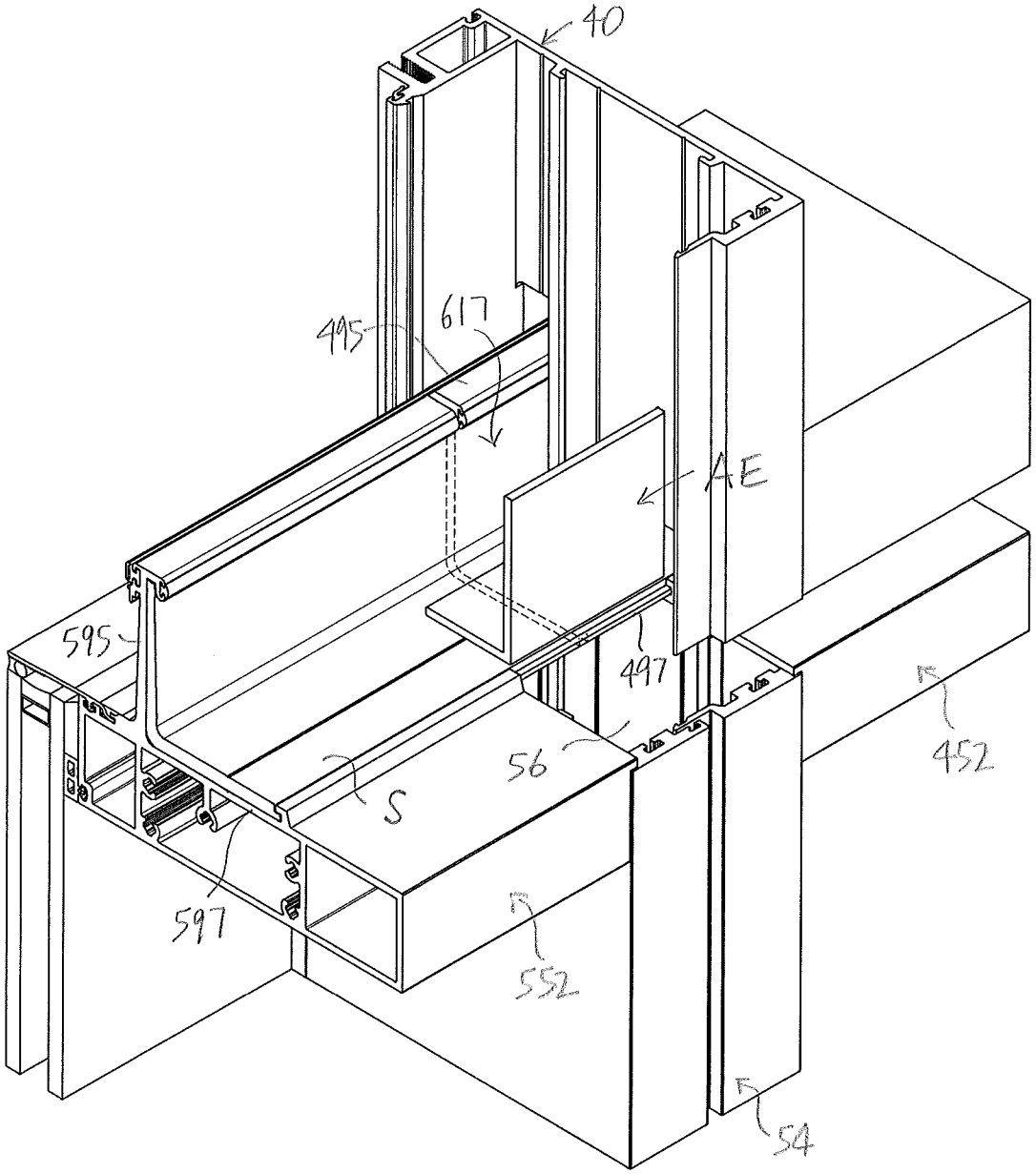
FIG. 12 is an isometric view of the rear side of the second transverse mullion segment of FIG. 11A with certain other additional elements.

As can be seen in FIG. 11B, in one embodiment, the respective bases 497, 597 and the arms 495, 595 of the respective second transverse mullion segments 452, 552 preferably extend laterally from the respective second body segments 457, 557 thereof toward each other. Preferably, the arms 495, 595 abut each other at a location that is generally in the centre of the mullion assembly 54 (FIGS. 11B, 12). As can be seen in FIG. 9A, the first main portion 30 preferably includes a lower opening "J". It will be understood that a corresponding opening preferably is also formed in the second main portion 40. The opening "J" permits the bases 497, 597 and the arms 495, 595 (and the silicone splice sheet 615 and the reinforcing and alignment angle element 617 engaged with the arms 495, 595) to extend into the central cavity 56 of the mullion assembly 54. Those skilled in the art would appreciate that connecting the left and right transverse mullion segments 452, 552 in this way strengthens the curtain wall system 20.

In one embodiment, the curtain wall system 20 of the invention preferably also includes one or more alignment elements "AE" that are positioned on the lower part "S" of the reinforcing and alignment angle element 617 to assist in the alignment of the abutting lower transverse mullion segments 452, 552 with each other (FIG. 12). It will be understood that the alignment element "AE" facilitates the alignment of an upper transverse mullion segment upon installation. It will also be understood that, in practice, the alignment element "AE" appears to be useful if used at vertical intervals, e.g., approximately once every five transverse mullions, counted vertically. It is believed that the use of more alignment elements than these would generally not be needed, in practice.

It will be understood that FIG. 10A is a cross-section of the panel unit 26. As can be seen in FIG. 10A, in one embodiment, the panel unit 26 preferably includes the second transverse mullion segment 52 positioned at the top end 69 for attachment with a first transverse mullion segment 50''' positioned at a bottom end 68''' of a later-installed panel unit 26'''.

Figure 6A:
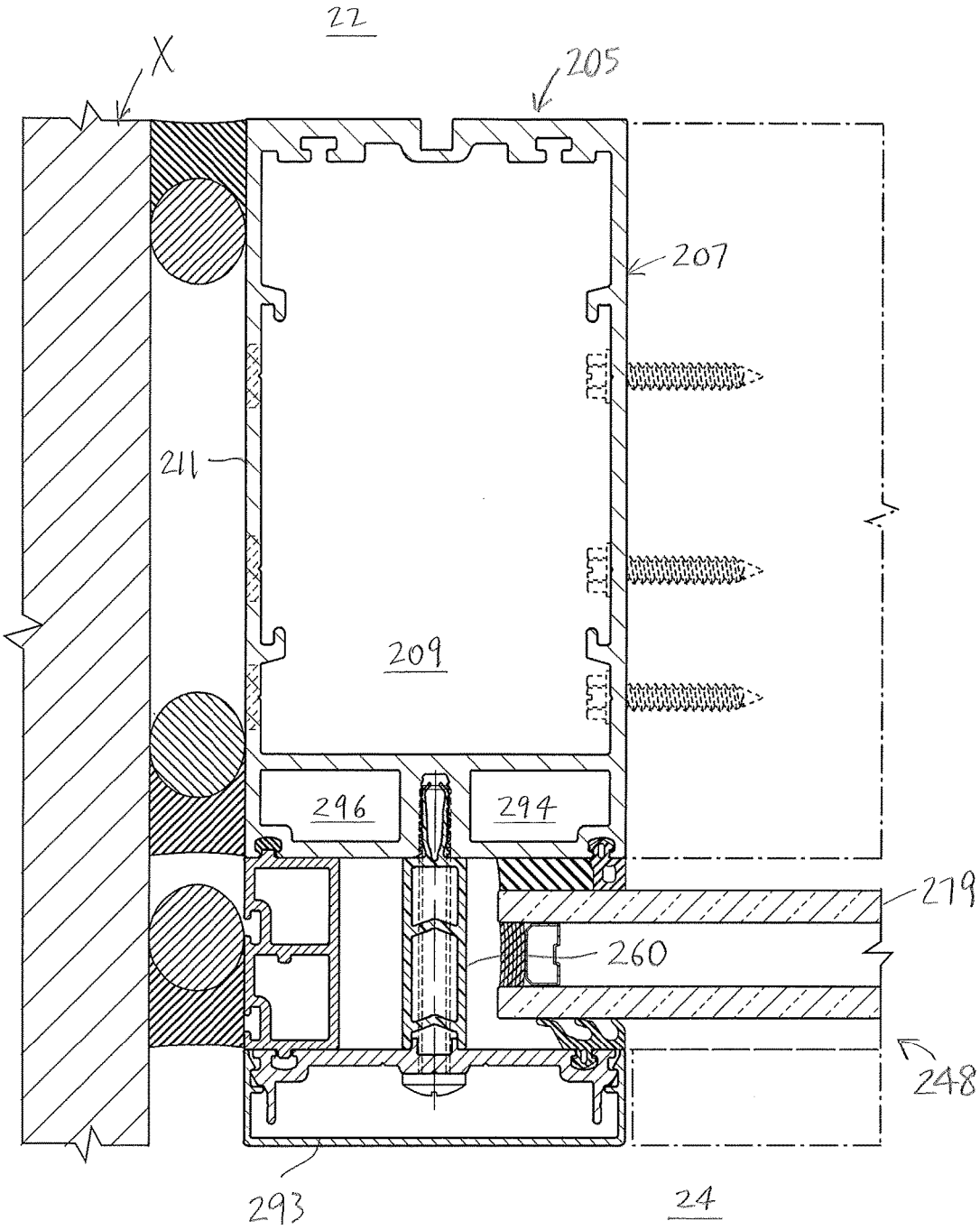
FIG. 6A is a cross-section of an embodiment of a jamb mullion assembly of the invention.

Those skilled in the art would appreciate that, in order to begin installation at an extreme left- or right-hand side of an area of the building structure 22 on which the curtain wall system 20 is to be located, it is preferred that a jamb mullion assembly 205 (FIG. 6A) is secured to an exposed part "X" of the building structure at a selected location thereon. As illustrated in FIG. 6A, the jamb mullion assembly 205 is formed to be secured to a left-hand side of the building structure, but those skilled in the art would appreciate that it may alternatively be formed for attachment to the right-hand side of the building structure. As can be seen, for example, in FIG. 6A, the jamb mullion assembly 205 is for securing a panel 248 in a selected position relative to the building structure 22, between the main (unexposed) part of the building structure 22 and the external space 24. In one embodiment, the jamb mullion assembly 205 preferably includes a jamb mullion body 207 defining a jamb mullion cavity 209 therein in which air is isolated for at least partially thermally insulating the building structure 22 relative to the external space 24. Preferably, the panel 248 includes a glazing unit 279 that is secured to the jamb mullion body 207 and extends from a preselected side of the jamb mullion body 207. For instance, as illustrated in FIG. 6A, the panel 248 and the glazing unit 279 thereof extend from the right side of the jamb mullion body 207. It is also preferred that the jamb mullion body 207 includes a closed side 211 thereof that is secured to the building structure 22.

In the embodiment illustrated in FIG. 6A, a thermal insulator element 260 is positioned between the jamb mullion body 207 and a cover element 293. The thermal insulator element 260 provides a thermal break between the cover element 293 and the jamb mullion body 207. As can also be seen in FIG. 6A, the mullion body 207 preferably also includes walls defining first and second cavities 294, 296 in which air is isolated, to provide thermal insulation between the thermal insulator element 260 and the cavity 209, to thermally insulate the main part of the building structure 22 relative to the external space 24.

Figure 6B:
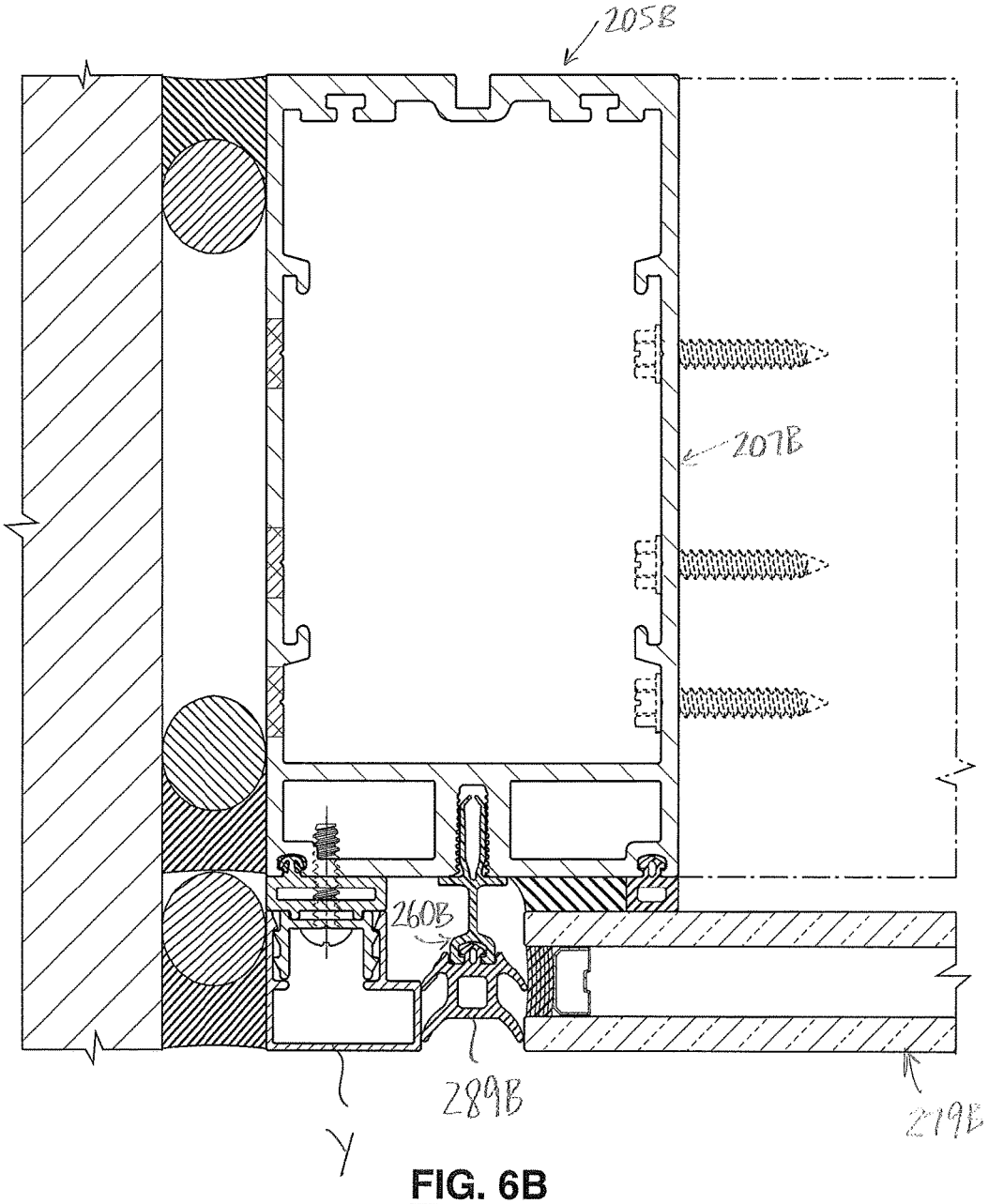
FIG. 6B is a cross-section of an alternative embodiment of the jamb mullion assembly of the invention.

As can be seen in FIG. 6B, in an alternative embodiment, the jamb mullion assembly 205B preferably includes an embodiment of the thermal insulator element 260B of the invention that includes an external engagement portion 289B to engage the glazing panel 279B and an exterior portion "Y", to thermally insulate the jamb mullion body 207B relative to the main part of the building structure 22.

Figure 7A:
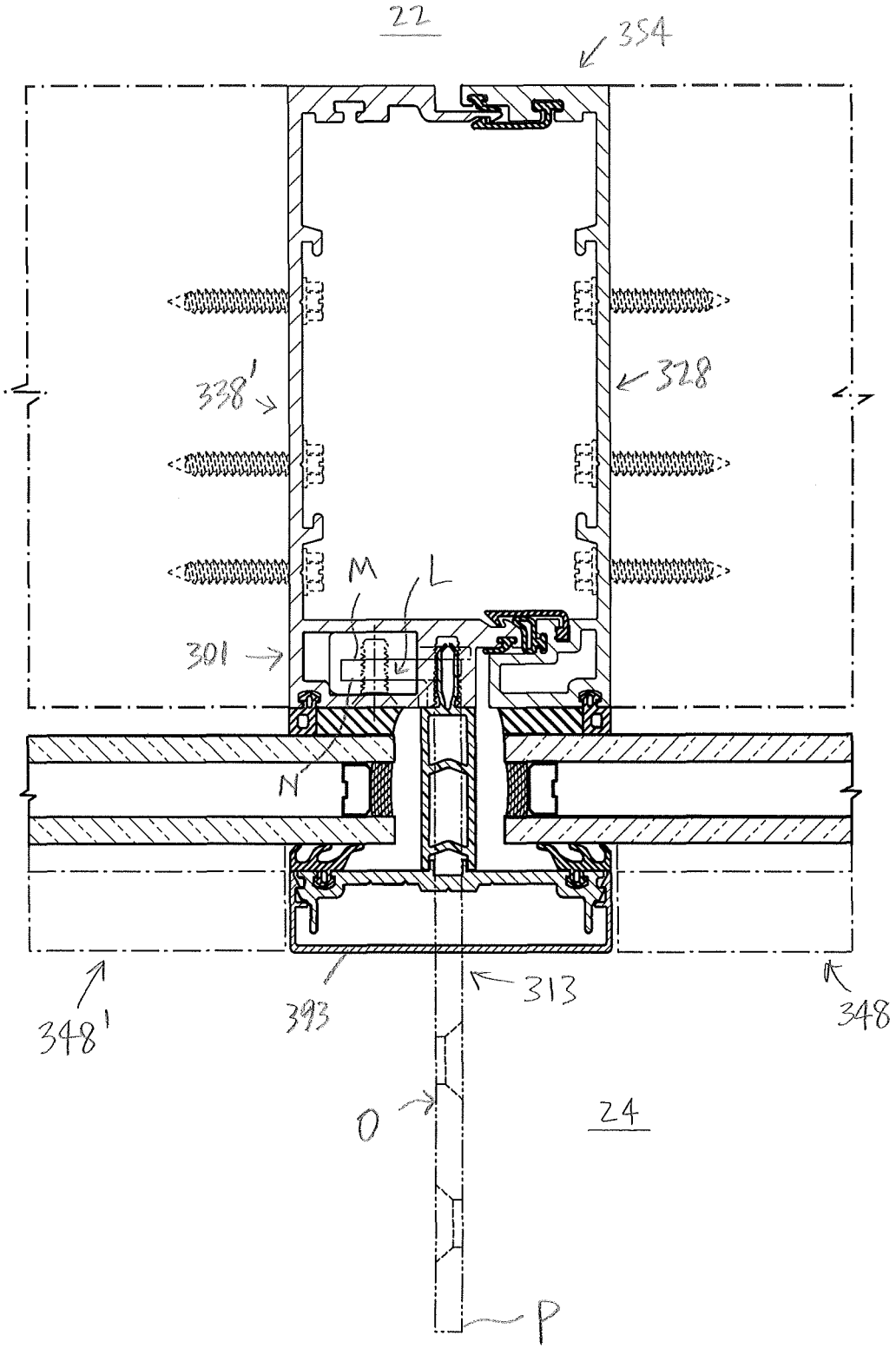
FIG. 7A is a cross-section of another alternative embodiment of the mullion assembly of the invention.
Figure 7B:
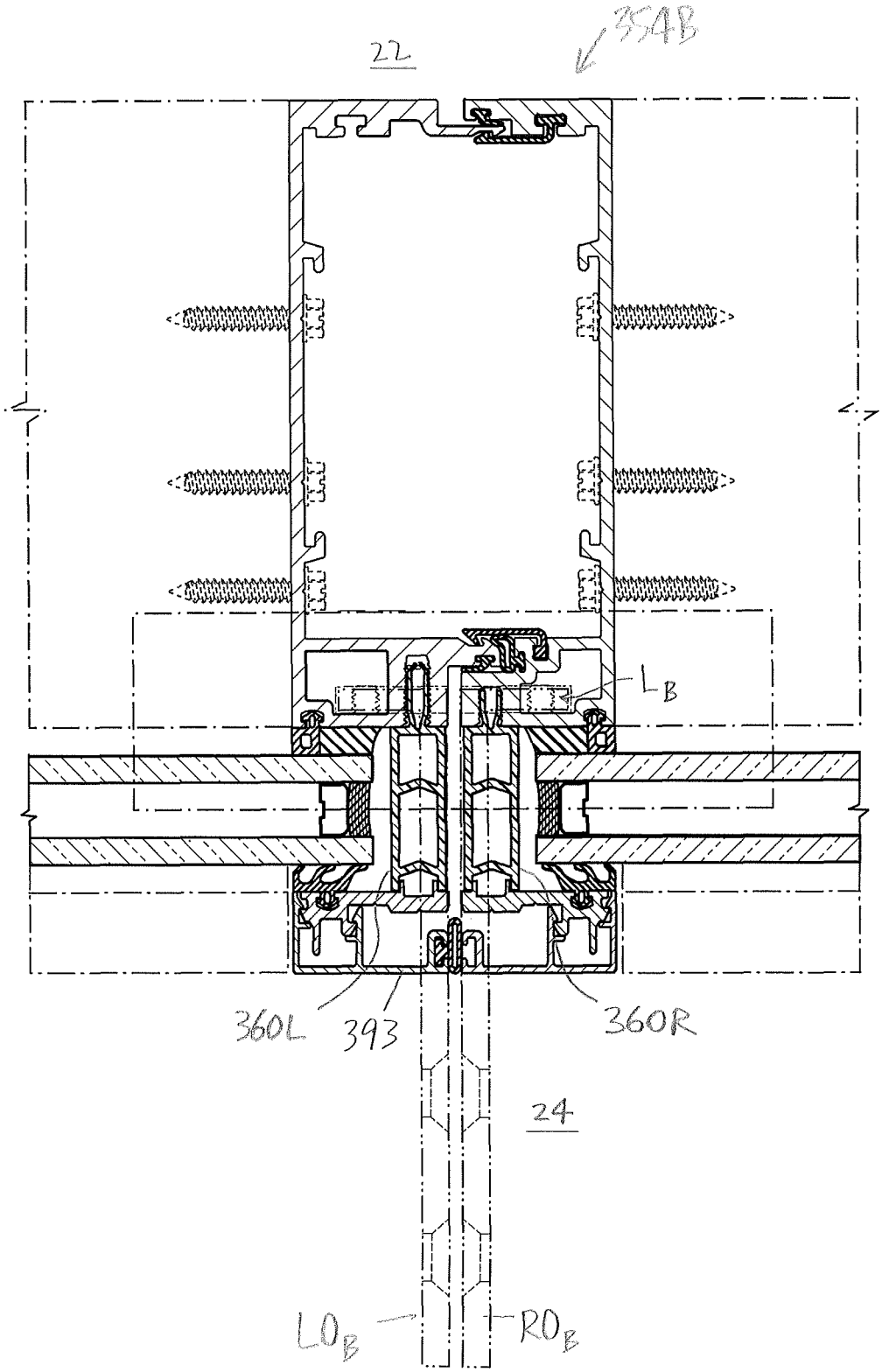
FIG. 7B is a cross-section of another alternative embodiment of the mullion assembly of the invention.

Those skilled in the art would also appreciate that the building design may require additional features to be included in the curtain wall system. In one embodiment, the mullion assembly 354 of the invention preferably includes a bracket subassembly 313 including a base plate "L" having opposed inner and outer surfaces "M", "N", and an outrigger element "O" secured to the base plate "L" and extending substantially orthogonally from the outer surface "N" of the base plate "L" to an end portion thereof "P" (FIG. 7A). As can be seen in FIGS. 7A and 7B, the base plate "L" preferably is securable to the mullion body 301 (i.e., formed when the first and second mullion segments 328, 338' are attached together), to locate at least a part of the end portion "P" extending past the panels 348, 348' and projecting into the external space. As can be seen in FIG. 7A, the bracket subassembly 313 preferably permits a sign or other object to be positioned outwardly from the panels 348, 348'. It will be understood that the thermal insulator element 360 preferably has a (vertical) break therein (not shown in FIG. 7A), to accommodate the outrigger element "O". Similarly, it will also be understood that the thermal insulator elements 360L, 360R preferably have breaks in them also respectively, to accommodate the outrigger elements "$LO_B$", "$RO_B$" (FIG. 7B). The cover element 393 also preferably includes one or more notches therein (not shown) to accommodate the outrigger element "O" (FIG. 7A), and in the embodiment illustrated in FIG. 7B, to accommodate the outrigger elements "$LO_B$", "$RO_B$".

Figure 7C:
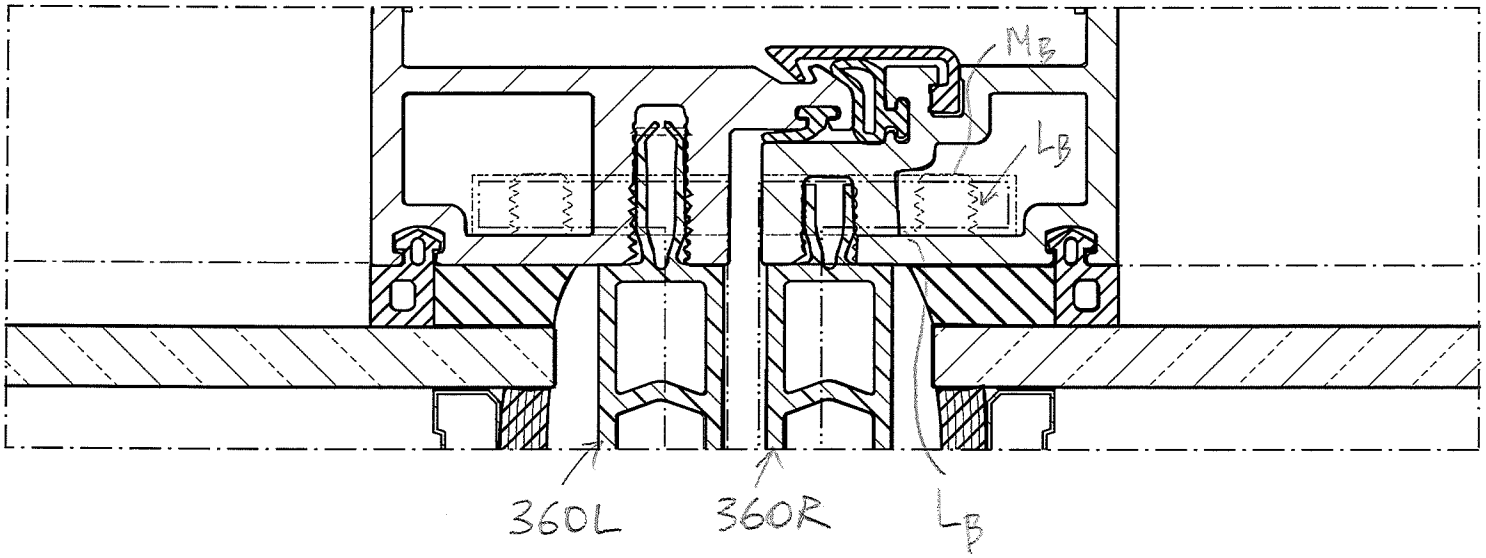
FIG. 7C is a cross-section of a portion of the mullion assembly of FIG. 7B, drawn at a larger scale.

An alternative embodiment of the mullion assembly 354B of the invention is illustrated in FIGS. 7B and 7C, in which the mullion assembly includes two thermal insulator elements 360L, 360R that are positioned to provide a thermal break between the external space 24 and the main part of the building structure 22. The mullion assembly 354B preferably includes a bracket assembly 313B with a base plate "$L_B$" having opposed inner and outer surfaces "$M_B$", "$N_B$" (FIG. 7C). The bracket assembly 313B preferably includes two outrigger elements "$LO_B$" and "$RO_B$" secured to the base plate "$L_B$". As can be seen in FIG. 7B, the mullion assembly 354B preferably also includes a cover element 393 to which the thermal insulator elements 360L, 360R are attached.

From the foregoing, it can be seen that the invention provides a method of securing the panel unit 26 in a predetermined position relative to the building structure 22, between the building structure 22 and the external space 24. In use, the method includes engaging the first mullion segment 28 with the substantially vertical second mullion segment 38' of the installed panel unit 26', to attach the first and second mullion segments 28, 38' to each other to form the mullion assembly 54. (It will be understood that the panel unit 26' is secured to the building structure 22 and to other panel units, having previously been so secured.) The mullion assembly 54 preferably defines the central cavity 56 therein, which is at least partially defined by the boundary region 58 in which the central volume of air is isolated for at least partially thermally insulating the building structure 22 relative to the external space 24. The thermal insulator element(s) 60 is (are) positioned between the boundary region 58 and the external space 24, for thermally insulating the building structure 22 relative to the external space 24. While the first mullion segment 28 is attached to the second mullion segment 38', the first transverse mullion segment 50 is engaged with the substantially horizontal second transverse mullion segment 52" located on the second installed panel unit 26", to attach the first and second transverse mullion segments 50, 52" to each other to provide the transverse central region 145 in which the transverse central volume of air is substantially isolated to at least partially insulate the building structure 22 relative to the external space 24. The engaged first and second transverse mullion segments 50, 52" define the separation region 158 between the building structure 22 and the external space 24. The transverse thermal insulator element 160 is positioned between the separation region 188 and the external space 24, for thermally insulating the building structure 22 relative to the external space 24.

Figure 8A:
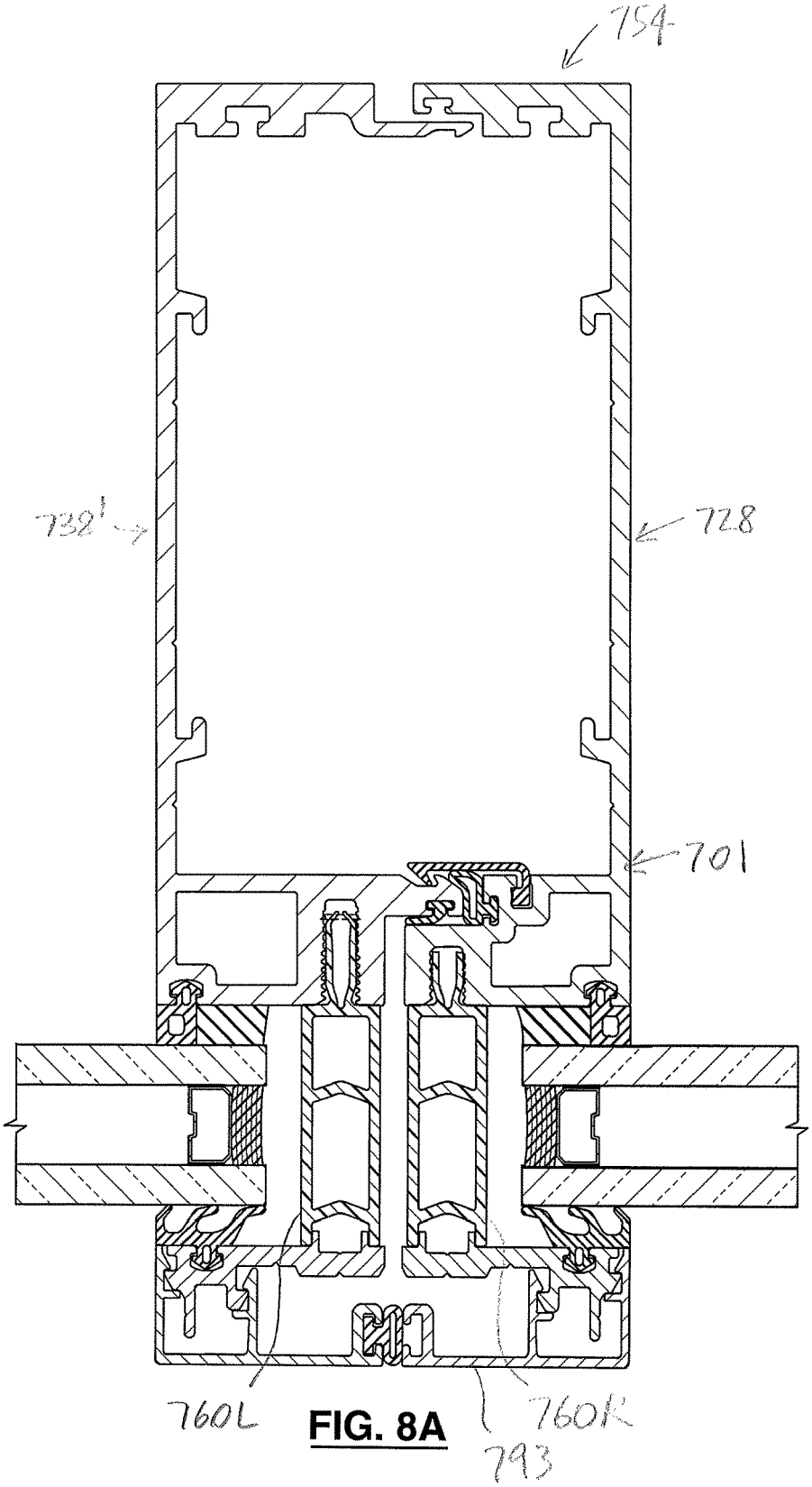
FIG. 8A is a cross-section of another alternative embodiment of the mullion assembly of the invention, drawn at a smaller scale.

Another alternative embodiment of the mullion assembly 754 is illustrated in FIG. 8A, in which first and second mullion segments 728, 738' support respective thermal insulator elements 760L, 760R. As can be seen in FIG. 8A, the thermal insulator elements 760L, 760R are engaged between a mullion body 701 (formed by the first and second mullion segments 728, 738') and a cover element 793.

Figure 8B:
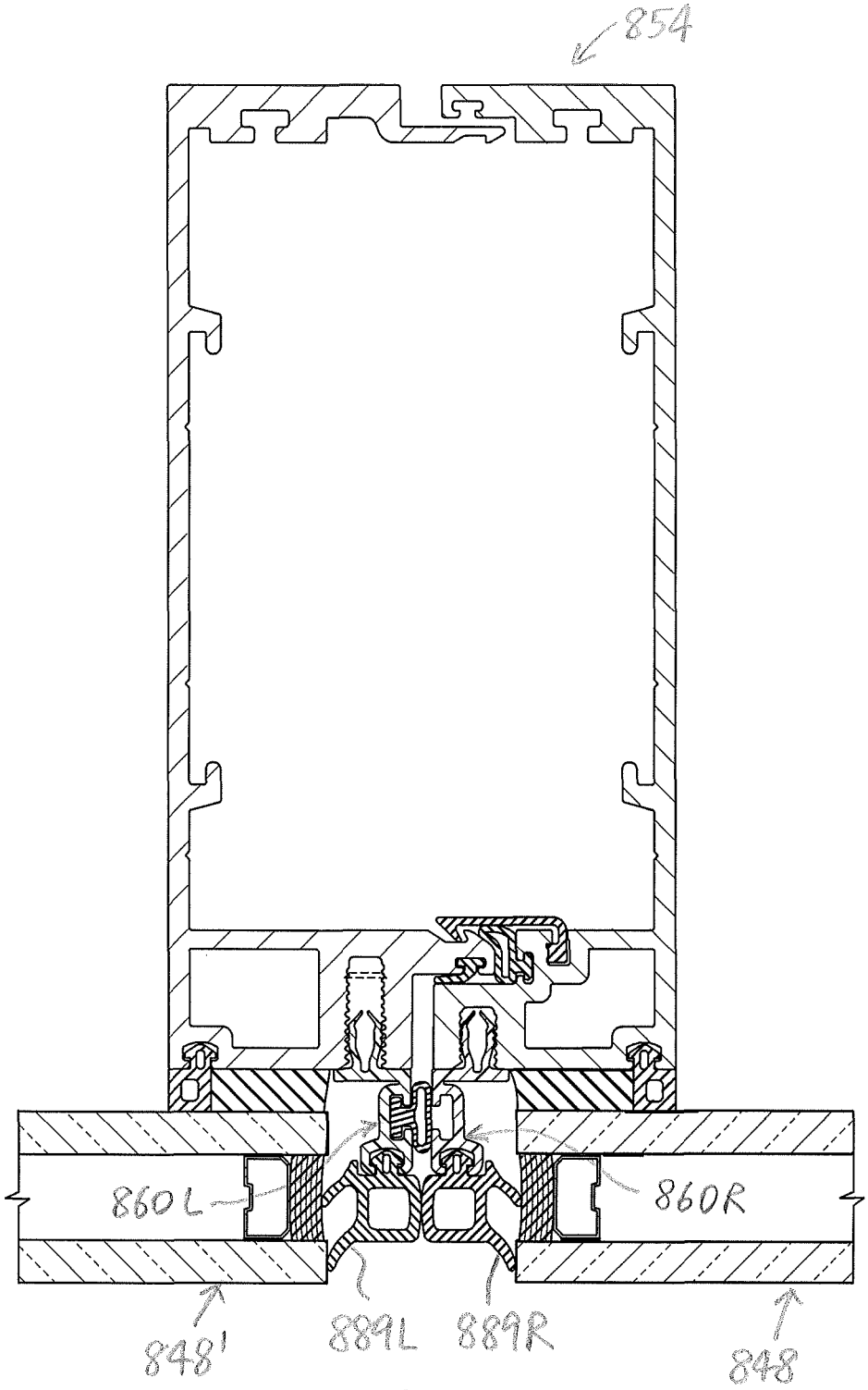
FIG. 8B is a cross-section of another alternative embodiment of the mullion assembly of the invention.

An alternative embodiment of the mullion assembly 854 of the invention is illustrated in FIG. 8B. As can be seen in FIG. 8B, the mullion assembly 854 does not include a cover element. Instead, the thermal insulator elements 860L, 860R preferably include respective external engagement portions 889L, 889R that engage the panels 848, 848' that they are positioned between.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A curtain wall system to be secured to a building structure and located between the building structure and an external space, the curtain wall system comprising:

a first panel unit and a second panel unit, one of the first panel unit or the second panel unit not installed on the building structure, the other of the first panel unit or the second panel unit installed on the building structure, each said panel unit comprising:

a first mullion segment comprising:

an elongate first main portion extending between first top and bottom ends thereof and comprising a first exterior side thereof, the elongate first main portion extending between inner and outer ends thereof;

a first outer portion extending from the first main portion at the outer end thereof;

a second mullion segment comprising:

an elongate second main portion extending between second top and bottom ends thereof and comprising a second exterior side thereof, the elongate second main portion extending between inner and outer ends thereof;

a second outer portion extending from the second main portion at the outer end thereof;

at least one panel positioned between the first and second mullion segments, said at least one panel comprising a glazing unit secured to the first outer portion and at least partially positioned between the external space and the first outer portion, the glazing unit secured to the second outer portion and at least partially positioned between the external space and the second outer portion;

the first mullion segment of the first panel unit being formed to cooperate with the second mullion segment of the second panel unit to provide a mullion assembly in which the first outer portion of the first mullion segment of the first panel unit and the second outer portion of the second mullion segment of the second panel unit partially define a central cavity of the mullion assembly in which a central volume of air is isolated for at least partially thermally insulating the building structure relative to the external space, the mullion assembly partially defining a boundary region between the central cavity and the external space;

the first outer portion of the first panel unit and the second outer portion of the second panel unit are configured such that outermost faces thereof are generally coplanar when the first mullion segment of the first panel unit is secured to the second mullion segment of the second panel unit in a horizontally adjacent position relative thereto;

at least one cover element formed to engage portions of each of the panels of the first panel unit and the second panel unit;

at least one thermal insulator element extending from said at least one cover element to the second outer portion of the second panel unit to provide a thermal break between the boundary region and the external space; and at least one fastener extending through said at least one thermal insulator element between said at least one cover element and the second outer portion of the second panel unit to secure said at least one cover element thereto, wherein the at least one fastener is received in a recess formed inwardly of the outermost face of the second outer portion of the second panel unit.

2. A curtain wall system according to claim 1 in which:

the first outer portion comprises an outer aperture therein;

the horizontally adjacent second outer portion comprises an outer peg at least partially receivable in the outer aperture;

the outer peg comprises an inner side with an inner side catch thereon and an opposed outer side with an outer wiper blade mounted thereon, the outer peg extending to an end part thereof;

the outer aperture is at least partially defined by a flexible inner engagement clip with a catch thereon positioned to engage the inner side of the outer peg, an outer wall thereof, and a bulb gasket positioned between the flexible inner engagement clip and the outer wall; and upon the outer peg being inserted into the outer aperture to a fully inserted position therein, the catch is engaged with the inner side catch of the outer peg to retain the outer peg in the outer aperture, the outer wiper blade engages the outer wall, and the end part of the outer peg engages the gasket, to provide at least a partial outer seal between the external space and the central cavity.

3. A curtain wall system according to claim 1 additionally comprising at least one transverse mullion assembly securing said at least one first panel of the one of the first panel unit or the second panel unit not installed on the building structure in a predetermined position relative to a vertically adjacent panel of a third panel unit previously installed on the building structure between the building structure and the external space, said at least one transverse mullion assembly comprising:

a first transverse mullion segment comprising:

an elongate first main transverse portion extending between inner and outer ends thereof;

the first main transverse portion comprising a first body segment comprising first front and rear walls and at least one first side wall at least partially defining a transverse central region in which a transverse central volume of air is isolated for thermally insulating the building structure relative to the external space;

a first outer transverse portion attached to the first main transverse portion at the outer end and extending substantially orthogonally from the first main transverse portion;

the first outer transverse portion and the first front wall defining a slot therebetween ending at the first body segment;

said at least one panel comprising the first glazing unit secured to the first outer transverse portion and at least partially positioned between the external space and the first outer transverse portion;

the vertically adjacent panel comprising a vertically adjacent second transverse mullion segment comprising:

an elongate second main transverse portion extending between inner and outer ends thereof;

the second main transverse portion comprising a second body segment comprising second front and rear walls and at least one second side wall at least partially defining a second central region in which a second central volume of air is isolated for thermally insulating the building structure relative to the external space;

the second main transverse portion comprising a second outer transverse portion positioned outwardly relative to the second central region;

an arm subassembly attached to the second main transverse portion and comprising an arm extending substantially orthogonally from a base of the arm subassembly secured to the at least one second side wall of the second main transverse portion, the arm being at least partially receivable in the slot in a secured position in which the arm is sealably engaged with the first outer transverse portion and the first front wall;

the vertically adjacent panel comprising a second glazing unit secured to the second outer transverse portion and at least partially positioned between the external space and the second outer transverse portion;

a gasket at least partially positionable between the first transverse mullion segment and the vertically adjacent second transverse mullion segment between the arm and the external space when the arm is in the secured position in the slot to at least partially thermally insulate the building structure relative to the external space;

when the arm is in the secured position in the slot, respective outer faces of the first and second transverse outer portions are aligned, the first and second outer transverse portions and the arm define a separation region between the transverse central region and the external space, and the arm defines a gap in the slot between the arm and the first body segment;

a trim element positioned between the first glazing unit and the external space;

a transverse cover element vertically adjacent to the trim element;

at least one transverse thermal insulator element at least partially positionable between the transverse cover element and the outer face of the first outer transverse portion, to at least partially define at least one thermal break between the transverse cover element and the separation region; and a transverse fastener extending between the transverse cover element and the first outer transverse portion, and through said at least one transverse thermal insulator element, to engage the first outer transverse portion, for securing the transverse cover element thereto.

4. A curtain wall system according to claim 1 in which said at least one panel comprises a first upper panel and a first lower panel, the curtain wall system comprising:

an intermediate mullion assembly for securing the first upper panel and the first lower panel relative to a building structure between the building structure and an external space, the intermediate mullion assembly comprising:

an intermediate body defining an intermediate cavity therein in which air is isolated for at least partially thermally insulating the building structure relative to the external space;

the intermediate body being securable to the upper and lower panels;

an intermediate cover element;

at least one intermediate thermal insulator element at least partially positionable between the first upper panel and the first lower panel, to at least partially define at least one thermal break between the external space and the intermediate body, said at least one intermediate thermal insulator engaging the intermediate cover element and the outer face of the outer wall; and an intermediate fastener extending between the intermediate cover element and the intermediate body, and through said at least one intermediate thermal insulator element, to engage the intermediate body to secure the intermediate cover element to the intermediate body, the cover element comprising wiper elements for sealably engaging the first upper and lower panels.

5. The system according to claim 1 in which the second outer portion of the second panel unit comprises a slot therein defined by a slot wall in which an inner end of said at least one thermal insulator element is received and in which a segment of said at least one fastener is positioned to urge the inner end of said at least one thermal insulator element against the slot wall, to secure said at least one cover element to the second outer portion of the second panel unit.

6. The system according to claim 5 in which the slot wall is threaded and the segment of said at least one fastener is formed for threadably urging the inner end of said at least one thermal insulator element against the slot wall.

7. The system of claim 1 wherein the recess into which the at least one fastener extends is formed in the boundary region.

8. The system of claim 7 wherein the recess into which the at least one fastener extends is entirely inward of the at least one first panel.

9. The system of claim 8 further including a seal between the at least one first panel and the outer face of the first outer portion, wherein the recess into which the at least one fastener extends is inward of the seal.

10. The system of claim 9 wherein the first outer portion includes a cavity in the boundary region.

11. The system of claim 8 further including a gasket between the first and second mullion segments, the gasket being inward of the recess.

12. The system of claim 1 wherein the glazing unit of the second panel unit is secured to the horizontally adjacent second outer portion by adhesive.

13. The system of claim 12 wherein said glazing unit of the first panel unit is secured to the first outer portion of the first panel unit by adhesive, the adhesive directly secured to the glazing unit of the first panel unit and directly secured to the first outer portion of the first panel unit.

14. The system of claim 1 wherein the outermost face of the first outer portion and the outermost face of the second outer portion are generally coplanar and wherein the at least one thermal insulator element extends to a plane containing the first outer face and the second outer face.

15. The system of claim 14 wherein said glazing unit of the first panel unit is secured to the first outer portion by adhesive, the adhesive directly secured to the glazing unit of the first panel unit and directly secured to the first outer portion of the first panel unit.

16. A method of securing a first panel unit in a predetermined position beside a horizontally adjacent second panel unit that is secured to a building structure, the second panel unit being located between the building structure and an external space, the method comprising:

(a) attaching a first mullion segment of the first panel unit with a horizontally adjacent second mullion segment of the second panel unit to provide a mullion assembly in which a first outer portion of the first mullion segment and a second outer portion of the horizontally adjacent second mullion segment partially define a central cavity therein in which a central volume of air is isolated for thermally insulating the building structure relative to the external space, the mullion assembly partially defining a boundary region between the central cavity and the external space, the first and second outer portions comprising respective outermost faces that are coplanar when the mullion assembly is formed, and to position first and second panels associated with the first mullion segment and the horizontally adjacent second mullion segment respectively between the boundary region and the external space, the first and second panels comprising first and second glazing units respectively;

(b) providing at least one cover element configured for engaging portions of each of the first and second glazing units;

(c) positioning at least one thermal insulator element partially between said at least one cover element and the outermost face of a selected one of the first outer portion of the first mullion segment and the second outer portion of the horizontally adjacent second mullion segment, such that the at least one thermal insulator element abuts the selected outermost face and abuts the at least one cover element, to provide a thermal break between the boundary region and the external space; and (d) positioning at least one fastener to extend from said at least one cover element through said at least one thermal insulator element to the selected one of the first outer portion of the first mullion segment and the second outer portion of the horizontally adjacent second mullion segment to secure said at least one cover element to the selected one of the first outer portion of the first mullion segment and the second outer portion of the horizontally adjacent second mullion segment;

wherein the first glazing unit is secured to the first mullion segment prior to said step a).

17. The method of claim 16 wherein the at least one fastener is received in a recess formed inwardly of the outer face of the selected one of the first outer portion of the first mullion segment and the horizontally adjacent second outer portion.

18. The method of claim 16 wherein the at least one fastener extends into a recess formed in the boundary region.

19. The method of claim 18 wherein the recess into which the at least one fastener extends is inward of the first panel.

20. The method of claim 19 wherein a gasket is positioned between the first and second mullion segments, the gasket being inward of the recess.

21. The method of claim 16 further including a seal between the first panel and the outermost face of the first outer portion, wherein the at least one fastener extends into a recess that is inward of the seal.

22. The method of claim 16 wherein the at least one fastener extends into a recess formed in the boundary region and wherein the first outer portion includes a cavity in the boundary region.

23. The method of claim 16 wherein the second glazing unit is secured to the second mullion segment prior to said step a).

24. The method of claim 16 wherein the first glazing unit is secured to the first mullion segment prior to said steps a), c) and d).

* * * * *